US007134494B2

(12) United States Patent
Zupanick et al.

(10) Patent No.: US 7,134,494 B2
(45) Date of Patent: Nov. 14, 2006

(54) METHOD AND SYSTEM FOR RECIRCULATING FLUID IN A WELL SYSTEM

(75) Inventors: Joseph A. Zupanick, Pineville, WV (US); Monty Rial, Dallas, TX (US)

(73) Assignee: CDX Gas, LLC, Dallas, TX (US)

( * ) Notice: Subject to any disclaimer, the term of this patent is extended or adjusted under 35 U.S.C. 154(b) by 277 days.

(21) Appl. No.: 10/457,103

(22) Filed: Jun. 5, 2003

(65) Prior Publication Data

US 2004/0244974 A1 Dec. 9, 2004

(51) Int. Cl.
*E21B 43/40* (2006.01)

(52) U.S. Cl. ..... 166/267; 166/50; 175/66; 175/206; 175/207

(58) Field of Classification Search ..... 166/250.01, 166/250.03, 252.1, 267, 369, 305.1, 75.12, 166/50, 52, 90.1; 175/66, 206, 207
See application file for complete search history.

(56) References Cited

U.S. PATENT DOCUMENTS

| | | | |
|---|---|---|---|
| 54,144 | A | 4/1866 | Hamar |
| 274,740 | A | 3/1883 | Douglass |
| 526,708 | A | 10/1894 | Horton |
| 639,036 | A | 12/1899 | Heald |
| 1,189,560 | A | 7/1916 | Gondos |
| 1,285,347 | A | 11/1918 | Otto |
| 1,467,480 | A | 9/1923 | Hogue |
| 1,485,615 | A | 3/1924 | Jones |
| 1,488,106 | A | 3/1924 | Fitzpatrick |
| 1,520,737 | A | 12/1924 | Wright |
| 1,674,392 | A | 6/1928 | Flansburg |
| 1,777,961 | A | 10/1930 | Capeliuschnicoff |
| 2,018,285 | A | 10/1935 | Schweitzer et al. |
| 2,069,482 | A | 2/1937 | Seay |
| 2,150,228 | A | 3/1939 | Lamb |
| 2,169,718 | A | 8/1939 | Boll et al. |
| 2,335,085 | A | 11/1943 | Roberts |
| 2,450,223 | A | 9/1948 | Barbour |
| 2,490,350 | A | 12/1949 | Grable |
| 2,679,903 | A | 6/1954 | McGowen, Jr. et al. |

(Continued)

FOREIGN PATENT DOCUMENTS

| | | |
|---|---|---|
| CA | 2 278 735 | 1/1998 |

(Continued)

OTHER PUBLICATIONS

McCray and Cole, "Oil Well Drilling and Technology," University of Oklahoma Press, pp. 315-319, 1959.

(Continued)

*Primary Examiner*—Kenneth Thompson
(74) *Attorney, Agent, or Firm*—Fish & Richardson P.C.

(57) ABSTRACT

A method for recirculating fluid in a well system includes drilling a first well bore from a surface to a subterranean zone, and drilling an articulated well bore that is horizontally offset from the first well bore at the surface and that intersects the first well bore at a junction proximate the subterranean zone. The method also includes drilling a drainage bore from the junction into the subterranean zone, and receiving gas, water and particles produced from the subterranean zone at the junction via the drainage bore. The gas, water, and particles are received from the junction at the surface, and the water is separated from the gas and the particles. The method also includes determining an amount of water to circulate, and recirculating a portion of the separated water according to this determination.

37 Claims, 4 Drawing Sheets

U.S. PATENT DOCUMENTS

| | | | | |
|---|---|---|---|---|
| 2,726,063 | A | | 12/1955 | Ragland et al. |
| 2,726,847 | A | | 12/1955 | McCune et al. |
| 2,783,018 | A | | 2/1957 | Lytle |
| 2,797,893 | A | | 7/1957 | McCune et al. |
| 2,847,189 | A | | 8/1958 | Shook |
| 2,911,008 | A | | 11/1959 | Du Bois |
| 2,934,904 | A | | 5/1960 | Hendrix |
| 2,980,142 | A | | 4/1961 | Turak |
| 3,163,211 | A | | 12/1964 | Henley |
| 3,208,537 | A | | 9/1965 | Scarborough |
| 3,347,595 | A | | 10/1967 | Dahms et al. |
| 3,385,382 | A | | 5/1968 | Canalizo et al. |
| 3,443,648 | A | | 5/1969 | Howard |
| 3,473,571 | A | | 10/1969 | Dugay |
| 3,503,377 | A | | 3/1970 | Beatenbough et al. |
| 3,528,516 | A | | 9/1970 | Brown |
| 3,530,675 | A | | 9/1970 | Turzillo |
| 3,534,822 | A | | 10/1970 | Campbell et al. |
| 3,578,077 | A | * | 5/1971 | Glenn et al. ..... 166/68 |
| 3,582,138 | A | | 6/1971 | Loofbourow et al. |
| 3,587,743 | A | | 6/1971 | Howard |
| 3,684,041 | A | | 8/1972 | Kammerer, Jr. et al. |
| 3,692,041 | A | | 9/1972 | Bondi |
| 3,744,565 | A | | 7/1973 | Brown |
| 3,757,876 | A | | 9/1973 | Pereau |
| 3,757,877 | A | | 9/1973 | Leathers |
| 3,763,652 | A | | 10/1973 | Rinta |
| 3,800,830 | A | | 4/1974 | Etter |
| 3,809,519 | A | | 5/1974 | Gamer |
| 3,825,081 | A | | 7/1974 | McMahon |
| 3,828,867 | A | | 8/1974 | Elwood |
| 3,874,413 | A | | 4/1975 | Valdez |
| 3,887,008 | A | | 6/1975 | Canfield |
| 3,902,322 | A | | 9/1975 | Watanabe |
| 3,907,045 | A | | 9/1975 | Dahl et al. |
| 3,934,649 | A | | 1/1976 | Pasini, III et al. |
| 3,957,082 | A | | 5/1976 | Fuson et al. |
| 3,961,824 | A | | 6/1976 | Van Eek et al. |
| 4,011,890 | A | | 3/1977 | Andersson |
| 4,020,901 | A | | 5/1977 | Pisio et al. |
| 4,022,279 | A | | 5/1977 | Driver |
| 4,030,310 | A | | 6/1977 | Schirtzinger |
| 4,037,658 | A | | 7/1977 | Anderson |
| 4,060,130 | A | | 11/1977 | Hart |
| 4,073,351 | A | | 2/1978 | Baum |
| 4,089,374 | A | | 5/1978 | Terry |
| 4,116,012 | A | | 9/1978 | Abe et al. |
| 4,134,463 | A | | 1/1979 | Allen |
| 4,136,996 | A | | 1/1979 | Burns |
| 4,151,880 | A | | 5/1979 | Vann |
| 4,156,437 | A | | 5/1979 | Chivens et al. |
| 4,169,510 | A | | 10/1979 | Meigs |
| 4,182,423 | A | | 1/1980 | Ziebarth et al. |
| 4,189,184 | A | | 2/1980 | Green |
| 4,220,203 | A | | 9/1980 | Steeman |
| 4,221,433 | A | | 9/1980 | Jacoby |
| 4,222,611 | A | | 9/1980 | Larson et al. |
| 4,224,989 | A | | 9/1980 | Blount |
| 4,226,475 | A | | 10/1980 | Frosch et al. |
| 4,257,650 | A | | 3/1981 | Allen |
| 4,278,137 | A | | 7/1981 | Van Eek |
| 4,283,088 | A | | 8/1981 | Tabakov et al. |
| 4,296,785 | A | | 10/1981 | Vitello et al. |
| 4,299,295 | A | | 11/1981 | Gossard |
| 4,303,127 | A | | 12/1981 | Freel et al. |
| 4,305,464 | A | | 12/1981 | Masszi |
| 4,312,377 | A | | 1/1982 | Knecht |
| 4,317,492 | A | | 3/1982 | Summers et al. |
| 4,328,577 | A | | 5/1982 | Abbott et al. |
| 4,333,539 | A | | 6/1982 | Lyons et al. ..... 175/61 |
| 4,366,988 | A | | 1/1983 | Bodine |
| 4,372,398 | A | | 2/1983 | Kuckes |
| 4,386,665 | A | | 6/1983 | Dellinger |
| 4,390,067 | A | | 6/1983 | Willman |
| 4,396,076 | A | | 8/1983 | Inoue |
| 4,397,360 | A | | 8/1983 | Schmidt |
| 4,401,171 | A | | 8/1983 | Fuchs |
| 4,407,376 | A | | 10/1983 | Inoue |
| 4,415,205 | A | | 11/1983 | Rehm et al. |
| 4,417,829 | A | | 11/1983 | Berezoutzky |
| 4,422,505 | A | | 12/1983 | Collins |
| 4,437,706 | A | | 3/1984 | Johnson |
| 4,442,896 | A | | 4/1984 | Reale et al. |
| 4,463,988 | A | | 8/1984 | Bouck et al. |
| 4,494,616 | A | | 1/1985 | McKee |
| 4,502,733 | A | | 3/1985 | Grubb |
| 4,512,422 | A | | 4/1985 | Knisley |
| 4,519,463 | A | | 5/1985 | Schuh |
| 4,527,639 | A | | 7/1985 | Dickinson, III et al. |
| 4,532,986 | A | | 8/1985 | Mims et al. |
| 4,533,182 | A | | 8/1985 | Richards |
| 4,536,035 | A | | 8/1985 | Huffman et al. |
| 4,544,037 | A | | 10/1985 | Terry |
| 4,558,744 | A | | 12/1985 | Gibb |
| 4,565,252 | A | | 1/1986 | Campbell et al. |
| 4,573,541 | A | | 3/1986 | Josse et al. |
| 4,599,172 | A | | 7/1986 | Gardes |
| 4,600,061 | A | | 7/1986 | Richards |
| 4,603,592 | A | | 8/1986 | Siebold et al. |
| 4,605,076 | A | | 8/1986 | Goodhart |
| 4,611,855 | A | | 9/1986 | Richards |
| 4,618,009 | A | | 10/1986 | Carter et al. |
| 4,638,949 | A | | 1/1987 | Mancel |
| 4,646,836 | A | | 3/1987 | Goodhart |
| 4,651,836 | A | | 3/1987 | Richards |
| 4,662,440 | A | | 5/1987 | Harmon et al. |
| 4,674,579 | A | | 6/1987 | Geller et al. |
| 4,676,313 | A | | 6/1987 | Rinaldi |
| 4,702,314 | A | | 10/1987 | Huang et al. |
| 4,705,109 | A | | 11/1987 | Ledent et al. |
| 4,705,431 | A | | 11/1987 | Gadelle et al. |
| 4,715,440 | A | | 12/1987 | Boxell et al. |
| 4,718,485 | A | | 1/1988 | Brown et al. |
| RE32,623 | E | | 3/1988 | Marshall et al. |
| 4,727,937 | A | | 3/1988 | Shum et al. |
| 4,753,485 | A | | 6/1988 | Goodhart |
| 4,754,808 | A | | 7/1988 | Harmon et al. |
| 4,754,819 | A | | 7/1988 | Dellinger |
| 4,756,367 | A | | 7/1988 | Puri et al. |
| 4,763,734 | A | | 8/1988 | Dickinson et al. |
| 4,773,488 | A | | 9/1988 | Bell et al. |
| 4,776,638 | A | | 10/1988 | Hahn |
| 4,830,105 | A | | 5/1989 | Petermann |
| 4,832,122 | A | | 5/1989 | Corey et al. |
| 4,836,611 | A | | 6/1989 | El-Saie |
| 4,842,081 | A | | 6/1989 | Parant |
| 4,844,182 | A | | 7/1989 | Tolle |
| 4,852,666 | A | | 8/1989 | Brunet et al. |
| 4,883,122 | A | | 11/1989 | Puri et al. |
| 4,889,186 | A | | 12/1989 | Hanson et al. |
| 4,978,172 | A | | 12/1990 | Schwoebel et al. |
| 5,016,709 | A | | 5/1991 | Combe et al. |
| 5,016,710 | A | | 5/1991 | Renard et al. |
| 5,033,550 | A | | 7/1991 | Johnson et al. |
| 5,035,605 | A | | 7/1991 | Dinerman et al. |
| 5,036,921 | A | | 8/1991 | Pittard et al. |
| 5,074,360 | A | | 12/1991 | Guinn |
| 5,074,365 | A | | 12/1991 | Kuckes |
| 5,074,366 | A | | 12/1991 | Karlsson et al. |
| 5,082,054 | A | | 1/1992 | Kiamanesh |
| 5,111,893 | A | | 5/1992 | Kvello-Aune |
| 5,115,872 | A | | 5/1992 | Brunet et al. |
| 5,127,457 | A | | 7/1992 | Stewart et al. |
| 5,135,058 | A | | 8/1992 | Millgard et al. |

5,148,875 A 9/1992 Karlsson et al.
5,148,877 A 9/1992 MacGregor
5,165,491 A 11/1992 Wilson
5,168,942 A 12/1992 Wydrinski
5,174,374 A 12/1992 Hailey
5,193,620 A 3/1993 Braddick
5,194,859 A 3/1993 Warren
5,197,553 A 3/1993 Leturno
5,197,783 A 3/1993 Theimer et al.
5,199,496 A 4/1993 Redus et al.
5,201,817 A 4/1993 Hailey
5,217,076 A 6/1993 Masek
5,226,495 A 7/1993 Jennings, Jr.
5,240,350 A 8/1993 Yamaguchi et al.
5,242,017 A 9/1993 Hailey
5,242,025 A 9/1993 Neill et al.
5,246,273 A 9/1993 Rosar
5,255,741 A 10/1993 Alexander
5,271,472 A 12/1993 Leturno
5,287,926 A 2/1994 Grupping
5,289,888 A 3/1994 Talley
5,301,760 A 4/1994 Graham
5,343,965 A 9/1994 Talley et al.
5,355,967 A 10/1994 Mueller et al.
5,363,927 A 11/1994 Frank
5,385,205 A 1/1995 Hailey
5,394,950 A 3/1995 Gardes
5,402,851 A 4/1995 Baiton
5,411,082 A 5/1995 Kennedy
5,411,085 A 5/1995 Moore et al.
5,411,088 A 5/1995 LeBlanc et al. ..... 166/265
5,411,104 A 5/1995 Stanley
5,411,105 A 5/1995 Gray
5,431,220 A 7/1995 Lennon et al.
5,431,482 A 7/1995 Russo
5,435,400 A 7/1995 Smith
5,447,416 A 9/1995 Wittrisch
5,450,902 A 9/1995 Matthews
5,454,419 A 10/1995 Vloedman
5,458,209 A 10/1995 Hayes et al.
5,462,116 A 10/1995 Carroll
5,462,120 A 10/1995 Gondouin
5,469,155 A 11/1995 Archambeault et al.
5,477,923 A 12/1995 Jordan, Jr. et al.
5,485,089 A 1/1996 Kuckes
5,494,121 A 2/1996 Nackerud
5,499,687 A 3/1996 Lee
5,501,273 A 3/1996 Puri
5,501,279 A 3/1996 Garg et al.
5,584,605 A 12/1996 Beard et al.
5,613,242 A 3/1997 Oddo
5,615,739 A 4/1997 Dallas
5,653,286 A 8/1997 McCoy et al. ..... 166/105.5
5,669,444 A 9/1997 Riese et al.
5,676,207 A 10/1997 Simon et al.
5,680,901 A 10/1997 Gardes
5,690,390 A 11/1997 Bithell
5,697,445 A 12/1997 Graham
5,706,871 A 1/1998 Andersson et al.
5,720,356 A 2/1998 Gardes
5,727,629 A 3/1998 Blizzard, Jr. et al.
5,735,350 A 4/1998 Longbottom et al.
5,771,976 A 6/1998 Talley
5,775,433 A 7/1998 Hammett et al. ..... 166/98
5,775,443 A 7/1998 Lott
5,785,133 A 7/1998 Murray et al.
5,832,958 A 11/1998 Cheng
5,853,054 A 12/1998 McGarian et al.
5,853,056 A 12/1998 Landers
5,853,224 A 12/1998 Riese
5,863,283 A 1/1999 Gardes
5,868,202 A 2/1999 Hsu
5,868,210 A 2/1999 Johnson et al.
5,879,057 A 3/1999 Schwoebel et al.
5,884,704 A 3/1999 Longbottom et al.
5,917,325 A 6/1999 Smith
5,934,390 A 8/1999 Uthe
5,938,004 A 8/1999 Roberts et al.
5,941,307 A 8/1999 Tubel
5,941,308 A 8/1999 Malone et al.
5,944,107 A 8/1999 Ohmer
5,957,539 A 9/1999 Durup et al.
5,971,074 A 10/1999 Longbottom et al.
5,988,278 A 11/1999 Johnson
5,992,524 A 11/1999 Graham
6,012,520 A 1/2000 Yu et al.
6,015,012 A 1/2000 Reddick
6,019,173 A 2/2000 Saurer et al.
6,024,171 A 2/2000 Montgomery et al.
6,030,048 A 2/2000 Hsu
6,050,335 A 4/2000 Parsons
6,056,059 A 5/2000 Ohmer
6,062,306 A 5/2000 Gano et al.
6,065,550 A 5/2000 Gardes
6,065,551 A 5/2000 Gourley et al.
6,079,495 A 6/2000 Ohmer
6,089,322 A 7/2000 Kelley et al.
6,119,771 A 9/2000 Gano et al.
6,119,776 A 9/2000 Graham et al.
6,135,208 A 10/2000 Gano et al.
6,170,571 B1 1/2001 Ohmer
6,179,054 B1 1/2001 Stewart ..... 166/105.5
6,189,616 B1 2/2001 Gano et al.
6,192,988 B1 2/2001 Tubel
6,199,633 B1 3/2001 Longbottom
6,209,636 B1 4/2001 Roberts et al.
6,237,284 B1 5/2001 Erickson
6,244,340 B1 6/2001 McGlothen et al.
6,247,532 B1 6/2001 Ohmer
6,263,965 B1 7/2001 Schmidt et al.
6,279,658 B1 8/2001 Donovan et al.
6,280,000 B1 8/2001 Zupanick
6,283,216 B1 9/2001 Ohmer
6,318,457 B1 11/2001 Den Boer et al.
6,349,769 B1 2/2002 Ohmer
6,357,523 B1 3/2002 Zupanick
6,357,530 B1 3/2002 Kennedy et al.
6,425,448 B1 7/2002 Zupanick et al.
6,439,320 B1 8/2002 Zupanick
6,450,256 B1 9/2002 Mones
6,454,000 B1 9/2002 Zupanick
6,457,540 B1 10/2002 Gardes
6,470,978 B1 10/2002 Trueman et al.
6,478,085 B1 11/2002 Zupanick
6,478,885 B1 11/2002 Goodreau
6,491,101 B1 12/2002 Ohmer
6,497,556 B1 12/2002 Zupanick
6,554,063 B1 4/2003 Ohmer
6,557,628 B1 5/2003 Ohmer
6,561,288 B1 5/2003 Zupanick
6,564,867 B1 5/2003 Ohmer
6,566,649 B1 5/2003 Mickael
6,571,888 B1 6/2003 Comeau
6,575,235 B1 6/2003 Zupanick
6,575,255 B1 6/2003 Rial et al.
6,577,129 B1 6/2003 Thompson
6,581,455 B1 6/2003 Berger et al.
6,581,685 B1 6/2003 Burgess et al.
6,585,061 B1 7/2003 Radzinski
6,590,202 B1 7/2003 Mickael
6,591,903 B1 7/2003 Ingle
6,591,922 B1 7/2003 Rial et al.
6,595,301 B1 7/2003 Diamond et al.
6,595,302 B1 7/2003 Diamond et al.
6,598,686 B1 7/2003 Zupanick
6,604,580 B1 8/2003 Zupanick

| | | | |
|---|---|---|---|
| 6,604,910 | B1 | 8/2003 | Zupanick |
| 6,607,042 | B1 | 8/2003 | Hoyer et al. |
| 6,636,159 | B1 | 10/2003 | Winnacker |
| 6,639,210 | B1 | 10/2003 | Odom et al. |
| 6,644,422 | B1 | 11/2003 | Rial et al. |
| 6,646,411 | B1 | 11/2003 | Thompson et al. |
| 6,646,441 | B1 | 11/2003 | Thompson et al. |
| 6,653,839 | B1 | 11/2003 | Yuratich et al. |
| 6,662,870 | B1 | 12/2003 | Zupanick |
| 6,668,918 | B1 | 12/2003 | Zupanick |
| 6,679,322 | B1 | 1/2004 | Zupanick |
| 6,681,855 | B1 | 1/2004 | Zupanick |
| 6,688,388 | B1 | 2/2004 | Zupanick |
| 6,722,452 | B1 | 4/2004 | Rial et al. |
| 6,758,279 | B1 | 7/2004 | Moore et al. |
| 2001/0010432 | A1 | 8/2001 | Zupanick |
| 2001/0096336 | | 11/2001 | Zupanick |
| 2002/0007968 | A1 | 1/2002 | Gardes |
| 2002/0043404 | A1 | 4/2002 | Trueman et al. |
| 2002/0050358 | A1 | 5/2002 | Algeroy |
| 2002/0074120 | A1 | 6/2002 | Scott |
| 2002/0074122 | A1 | 6/2002 | Kelly et al. |
| 2002/0096336 | A1 | 7/2002 | Zupanick |
| 2002/0108746 | A1 | 8/2002 | Zupanick |
| 2002/0117297 | A1 | 8/2002 | Zupanick |
| 2002/0148605 | A1 | 10/2002 | Zupanick |
| 2002/0148613 | A1 | 10/2002 | Zupanick |
| 2002/0189801 | A1 | 12/2002 | Zupanick |
| 2003/0062198 | A1 | 4/2003 | Gardes |
| 2003/0066686 | A1 | 4/2003 | Conn |
| 2003/0075334 | A1 | 4/2003 | Haugen et al. |
| 2003/0106686 | A1 | 6/2003 | Ingle et al. |
| 2003/0164253 | A1 | 9/2003 | Trueman et al. |
| 2003/0221836 | A1 | 12/2003 | Gardes |
| 2003/0234120 | A1 | 12/2003 | Paluch et al. |
| 2004/0007389 | A1 | 1/2004 | Zupanick |
| 2004/0007390 | A1 | 1/2004 | Zupanick |
| 2004/0011560 | A1 | 1/2004 | Rial et al. |
| 2004/0020655 | A1 | 2/2004 | Rusby et al. |
| 2004/0031609 | A1 | 2/2004 | Zupanick |
| 2004/0033557 | A1 | 2/2004 | Scott et al. |
| 2004/0060351 | A1 | 4/2004 | Gunter et al. |
| 2004/0140129 | A1 | 7/2004 | Gardes |
| 2004/0159436 | A1 | 8/2004 | Zupanick |
| 2004/0226719 | A1 | 11/2004 | Morgan et al. |
| 2005/0133219 | A1 | 6/2005 | Zupanick |

FOREIGN PATENT DOCUMENTS

| | | | |
|---|---|---|---|
| CA | 2210866 | | 1/1998 |
| DE | CH 653 741 | | 1/1986 |
| DE | 197 25 996 | A1 | 1/1998 |
| EP | 0 819 834 | A1 | 1/1998 |
| EP | 0 875 661 | A1 | 11/1998 |
| EP | 0 952 300 | A1 | 10/1999 |
| EP | 1 316 673 | A2 | 6/2003 |
| FR | 964503 | | 4/1944 |
| GB | 442008 | | 1/1936 |
| GB | 444484 | | 3/1936 |
| GB | 651468 | | 4/1951 |
| GB | 893869 | | 4/1962 |
| GB | 2 255 033 | | 10/1992 |
| GB | 2297 988 | | 8/1996 |
| GB | 2 347 157 | A | 8/2000 |
| GB | 2347157 | | 8/2002 |
| SU | 750108 | | 6/1975 |
| SU | 876968 | | 10/1981 |
| SU | 1448078 | A1 | 3/1987 |
| SU | 1770570 | A1 | 3/1990 |
| WO | 94/21889 | | 9/1994 |
| WO | WO 94/28280 | | 12/1994 |
| WO | WO 97/21900 | | 6/1997 |
| WO | WO 98/25005 | | 6/1998 |
| WO | WO 98/35133 | | 8/1998 |
| WO | WO 99/60248 | | 11/1999 |
| WO | 00/31376 | | 6/2000 |
| WO | WO 00/79099 | | 12/2000 |
| WO | WO 01/44620 | | 6/2001 |
| WO | WO 02/18738 | | 3/2002 |
| WO | WO 02/059455 | | 8/2002 |
| WO | WO 02/061238 | A1 | 8/2002 |
| WO | WO 03/061238 | | 8/2002 |
| WO | WO 03/036023 | | 5/2003 |
| WO | WO 03/102348 | | 12/2003 |
| WO | WO 2004/035984 | A1 | 4/2004 |
| WO | WO 2005/003509 | A1 | 1/2005 |

OTHER PUBLICATIONS

Berger and Anderson, "Modern Petroleum," PennWell Books, pp. 106-108, 1978.

Arfon H. Jones et al., A Review of the Physical and Mechnaical Properties of Coal with Implications for Coal-Bed Methane Well Completion and Production, Rocky Mountain Association of Geologists, pp. 169-181, 1988.

Howard L. Hartman, et al.; "SME Mining Engineering Handbook;" Society for Mining, Metallurgy, and Exploration, Inc.; pp. 1946-1950, 2nd Edition, vol. 2, 1992.

Dave hassan, Mike Chernichen, Earl Jensen, and Morley Frank; "Multi-lateral technique lowers drilling costs, provides environmental benefits", Drilling Technology, pp. 41-47, Oct. 1999.

Gopal Ramaswamy, "Production History Provides CBM Insights," Oil & Gas Journal, pp. 49, 50 and 52, Apr. 2, 2001.

Weiguo Chi and Luwu Yang, "Feasibility of Coalbed Methane Exploitation in China," Horizontal Well Technology, p. 74, Sep. 2001.

Nackerud Product Description, Harvest Tool Company, LLC, 1 page, Received Sep. 27, 2001.

Gopal Ramaswamy, "Advanced Key for Coalbed Methane," The American Oil & Gas Reporter, pp. 71 & 73, Oct. 2001.

Joseph C. Stevens, Horizontal Applications For Coal Bed Methane Recovery, Strategic Research Institute, pp. 1-10 (slides), Mar. 25, 2002.

R.J. "Bob" Stayton, "Horizontal Wells Boost CBM Recovery", Special Report: Horizontal & Directional Drilling, The American Oil & Gas Reporter, pp. 71-75, Aug. 2002.

Susan Eaton, "Reversal of Fortune", New Technology Magazine, pp. 30-31, Sep. 2002.

James Mahony, "A Shadow of Things to Come", New Technology Magazine, pp. 28-29, Sep. 2002.

Documents Received from Third Party, Great Lakes Directional Drilling, Inc., (12 pages), Received Sep. 12, 2002.

Robert W. Taylor and Richard Russel, Multilateral Technologies Increase Operational Efficiencies in Middle East, Oil & Gas Journal, pp. 76-80, Mar. 16, 1998.

Adam Pasiczynk, "Evolution Simplifies Multilateral Wells", Directional Drilling, pp. 53-55, Jun. 2000.

Steven S. Bell, "Multilateral System with Full Re-Entry Access Installed", World Oil, p. 29, Jun. 1996.

P. Jackson and S. Kershaw, Reducing Long Term Methane Emissions Resulting from Coal Mining, Energy Convers. Mgmt, vol. 37, Nos. 6-8, pp. 801-806, 1996.

Pascal Breant, "Des Puits Branches, Chez Total : les puits multi drains", Total Exploration Production, pp. 1-5, Jan. 1999.

Abstract of AU 8549964, 1987.

E-Tronics, ABI Oil Tools, Tubing Rotator Operating Effectiveness, Models & Specifications, 1 page (cite in 206 only), Jun. 2002.

Zupanick, U.S. Appl. No. 09/788,897, entitled "Method and System for Accessing Subterranean Deposits From The Surface," (067083.0138), Feb. 20, 2001.

Zupanick, U.S. Appl. No. 10/046,001, entitled "Method and System for Management of By-Products From Subterranean Zones," (067083.0134), Oct. 19, 2001.

Zupanick, U.S. Appl. No. 09/769,098, entitled "Method and System for Enhancing Access to a Subterranean Zone" (067083.0162), Oct 30, 2001.

Zupanick, U.S. Appl. No. 10/004,316, entitled "Slant Entry Well System and Method," filed Oct. 30, 2001, 35 pages. (067083.0118), Jan. 24, 2001.
Zupanick, U.S. Appl. No. 09/774,996, entitled "Method and System for Accessing a Subterranean Zone From a Limited Surface Area," (067083.0120), Jan. 30, 2001.
Zupanick, U.S. Appl. No. 09/123,556, entitled "Method and System for Accessing a Subterranean Zone From a Limited Surface Area," (067083.0194), Apr. 15, 2002.
Zupanick, U.S. Appl. No. 10/142,817, entitled "Method and System for Underground Treatment of Materials," filed May 8, 2002, 54 pgs. (067083.0119), May 8, 2002.
Zupanick, U.S. Appl. No. 10/194,366, "Undulating Well Bore," (067083.0176), Jul. 12, 2002.
Zupanick, U.S. Appl. No. 10/194,367, "Ramping Well Bores," (067083.0179), Jul. 12, 2002.
Zupanick, U.S. Appl. No. 10/194,422, "Wellbore Plug System and Method," (067083.0188), Jul. 12, 2002.
Zupanick, U.S. Appl. No. 10/194,433, "Wellbore Plug System and Method," (067083.0189), Jul. 12, 2002.
Zupanick, U.S. Appl. No. 10/227,057 "System and Method for Subterranean Access" (0181), Aug. 22, 2002.
Zupanick, U.S. Appl. No. 10/244,082, Method and System for Controlling Pressure in a Dual Well System (0187), Sep. 12, 2002.
Zupanick, U.S. Appl. No. 10/244,083 "Three-Dimensional Well System for Accessing Subterranean Zones" (0190), Sep. 12, 2002.
Zupanick, U.S. Appl. No. 10/246,052, "Accelerated Production of Gas From a Subterranean Zone" (0175), Sep. 17, 2002.
Zupanick, U.S. Appl. No. 10/264,535, "Method and System for Removing Fluid From a Subterranean Zone Using an Enlarged Cavity" (0197), Oct. 3, 2002.
Zupanick, U.S. Appl. No. 10/267,426, "Method of Drilling Lateral Wellbores From a Slant Wall Without Utilizing a Whipstock" (0192), Oct. 8, 2002.
Zupanick, U.S. Appl. No. 10/323,192, "Method and System for Circulating Fluid in a Well", U.S. Appl. No. 10/323,192 (0195), Dec. 18, 2002.
Examiner on Record, Office Action Response regarding the Interpretation of the three Russian Patent Applications listed above under Foreign Patent Documents (9 pages), Date Unknown.
Documents Received from Third Party, Great Lakes Directional Drilling, Inc., (12 pages), Received Sep. 12, 2002.
Robert W. Taylor and Richard Russell, Multilateral Technologies Increase Operational Efficiencies in Middle East, Oil & Gas Journal, pp. 76-80, Mar. 16, 1998.
Adam Pasiczynk, "Evolution Simplifies Multilateral Wells", Directional Drilling, pp. 53-55, Jun. 2000.
Steven S. Bell, "Multilateral System with Full Re-Entry Access Installed", World Oil, p. 29, Jun. 1996.
Pascal Breant, "Des Puits Branches, Chez Total : les puits multi drains", Total Exploration Production, pp. 1-5, Jan. 1999.
Chi, Weiguo, "*A Feasible Discussion on Exploitation Coalbed Methane through Horizontal Network Drilling in China*", SPE 64709, Society of Petroleum Engineers (SPE International), 4 pages, Nov. 7, 2000.
Chi, Weiguo, "*Feasibility of Coalbed Methane Exploitation in China*", synopsis of paper SPE 64709, 1 page, Nov. 7, 2000.
Ian D. Palmer et al., "*Coalbed Methane Well Completions and Stimulations*", Chapter 14, pp. 303-339, Hydrocarbons from Coal, Published by the American Association of Petroleum Geologists, 1993.
Zupanick, U.S. Appl. No. 10/264,535, "Method and System for Removing Fluid From a Subterranean Zone Using an Enlarged Cavity", Aug. 15, 2003.
Notification of Transmittal of the International Search Report or the Declaration (PCT Rule 44.1) mailed Nov. 6, 2003 (8 pages) re International Application No. PCT/US 03/21626, Jul. 11, 2003.
Notification of Transmittal of the International Search Report or the Declaration (PCT Rule 44.1) mailed Nov. 5, 2003 (8 pages) re International Application No. PCT/US 03/21627, Jul. 11, 2003.
Notification of Transmittal of the International Search Report or the Declaration (PCT Rule 44.1) mailed Nov. 4, 2003 (7 pages) re International Application No. PCT/US 03/21628, Jul. 11, 2003.
Notification of Transmittal of the International Search Report or the Declaration (PCT Rule 44.1) mailed Dec. 5, 2003 (8 pages) re International Application No. PCT/US 03/21750, Jul. 11, 2003.
Notification of Transmittal of the International Search Report or the Declaration (PCT Rule 44.1) mailed Dec. 19, 2003 (8 pages) re International Application No. PCT/US 03/28137, Filed Sep. 9, 2003.
Notification of Transmittal of the International Search Report or the Declaration (PCT Rule 44.1) mailed Feb. 4, 2004 (8 pages) re International Application No. PCT/US 03/26124, Filed Sep. 9, 2003.
Smith, Maurice, "*Chasing Unconventional Gas Unconventionally*," CBM Gas Technology, New Technology Magazine, Oct./Nov. 2003, pp. 1-4.
Gardes, Robert "*A New Direction in Coalbed Methane and Shale Gas Recovery*," (to the best of Applicants' recollection, first received at The Canadian Institute Coalbed Methane Symposium conference on Jun. 16 and Jun. 17, 2002), 1 page of conference flyer, 6 pages of document.
Gardes, Robert, "*Under-Balance Multi-Lateral Drilling for Unconventional Gas Recovery*," (to the best of Applicants' recollection, first received at The Unconventional Gas Revolution conference on Dec. 9, 2003), 4 pages of conference flyer, 33 pages of document.
Boyce, Richard "*High Resolution Selsmic Imaging Programs for Coalbed Methane Development*," (to the best of Applicants' recollection, first received at The Unconventional Gas Revolution conference on Dec. 10, 2003) 4 pages of conference flyer, 24 pages of document.
Mark Mazzella and David Strickland,"*Well Control Operations on a Multiwell Platform Blowout*," WorldOil.com—Online Magazine Article, vol. 22, Part I—pp. 1-7, and Part II—pp. 1-13, Jan. 2002.
Vector magnetics LLC, Case History, California, May 1999, "*Successful Kill of a Surface Blowout*," pp. 1-12.
Cudd Pressure Control, Inc, "*Successful Well Control Operations-A Case Study: Surface and Subsurface Well Interventionon a Multi-Well Offshore Platform Blowout and Fire*," pp. 1-17, http://www.cuddwellcontrol.com/literature/successful/successful_well.htm, 2000.
R. Purl, et al., "*Damage to Coal Permeability During Hydraulic Fracturing*," pp. 109-115 (SPE 21813), 1991.
U.S. Dept. of Energy—Office of Fossil Energy, "*Multi-Seam Well Completion Technology: Implications for Powder River Basin Coalbed Methane Production*," pp. 1-100, A-1 through A10, Sep. 2003.
U.S. Dept. of Energy—Office of Fossil Energy, "*Powder River Basin Coalbed Methane Development and Produced Water Management Study*," pp. 1-111, A-1 through A14, Sep. 2003.
Zupanick, U.S. Patent Application, entitled Method and System for Controlling the Production Rate . . . , U.S. Appl. No. 10/328,408, filed Dec. 23, 2002.
Rial, U.S. Patent Application, entitled Method and System for Accessing a Subterranean Zone from a Limited Surface Area, U.S. Appl. No. 10/188,141, filed Jul. 1, 2002.
Zupanick, U.S. Patent Application, entitled "Wellvore Sealing System and Method," U.S. Appl. No. 10/406,037 Published, filed Jul. 12, 2002.
B. Goktas et al., "*Performances of Openhole Completed and Cased horizontal/Undulating Wells in Thin-Bedded, Tight Sand Gas Reservoirs*," SPE 65619, Society of Petroleum Engineers, Oct. 17-19, 2000 (7 pages).
Sharma, R., et al., "*Modelling of Undulating Wellbore Trajectories*," The Journal of Canadian Petroleum Technology, vol. 34, No. 10, XP-002261908, Oct. 18-20, 1993 pp. 16-24 (9 pages).
Balbinski, E.F., "*Prediction of Offshore Viscous Oil Field Performance*," European Symposium on Improved Oil Recovery, Aug. 18-20, 1999, 10 pages.
Notification of Transmittal of the International Search Report or the Declaration (PCT Rule 44.1) (3 pages) and International Search Report (7 pages) re International Application No. PCT/US 03/04771 mailed Jul. 4, 2003.

Notification of Transmittal of the International Search Report or the Declaration (PCT Rule 44.1) (3 pages) and International Search Report (5 pages) re International Application No. PCT/US 03/21891 mailed Nov. 13, 2003.
Notification of Transmittal of the International Search Report or the Declaration (PCT Rule 44.1) (3 pages) and International Search Report (4 pages) re International Application No. PCT/US 03/38383 mailed Jun. 2, 2004.
U.S. Dept. of Energy—Office of Fossil Energy, "*Powder River Basin Coalbed Methane Development and Produced Water Management Study*," Nov. 2002, pp. 1-111, A-1 through A-14 (213 pages).
Kalinin, et al., Translation of Selected pages from Ch. 4, Sections 4.2 (p. 135), 10.1 (p. 402), 10.4 (pp. 418-419), "*Drilling inclined and Horizontal Well Bores*," Moscow, Nedra Publishers, 1997, 4 pages.
Jet Lavanway Exploration, "*Well Survey*," Key Energy Surveys, Nov. 2, 1997, 3 pages.
Precision Drilling, "*We Have Roots in Coal Bed Methan Drilling*," Technology Services Group, Published on or before Aug. 5, 2002, 1 page.
U.S. Dept. of Energy, "*New Breed of CBM/CMM Recovery Technology*," Jul. 2003, 1 page.
Ghiselin, Dick, "*Unconventional Vision Frees Gas Reserves*," Natural Gas Quarterly, Sep. 2003, 2 pages.
CBM Review, World Coal, "*US Drilling into Asia*," Jun. 2003, 4 pages.
Skrebowski, Chris, "*US Interest in North Korean Reserves*," Petroleum, Energy Institute, Jul. 2003, 4 pages.
Zupanick, U.S. Patent Application entitled "Method and System for Accessing Subterranean Deposits from the Surface and Tools Therefor," U.S. Appl. No. 10/630,345, Jul. 29, 2003 (366 pages).
Pauley, Steven, U.S. Patent Application entitled "Multi-Purpose Well Bores and Method for Accessing a Subterranean Zone From the Surface," U.S. Appl. No. 10/715,300, Nov. 17, 2003 (34 pages).
Seams, Douglas, U.S. Patent Application entitled "Method and System for Extraction of Resources from a Subteranean Well Bore," U.S. Appl. No. 10/723,322, Nov. 26, 2003 (40 pages).
Zupanick, U.S. Patent Application entitled "Slant Entry Well System and Method," U.S. Appl. No. 10/749,884, Dec. 31, 2003 (28 pages).
Zupanick, U.S. Patent Application entitled "System and Method for Accessing Subterranean Deposits from the Surface," U.S. Appl. No. 10/761,629, Jan. 30, 2004 (38 pages).
Zupanick, U.S. Patent Application entitled "System and Method for Testing A Partially Formed Hydrocarbon Well for Evaluation and Well Planning Refinement," U.S. Appl. No. 10/769,221, Jan. 30, 2004 (34 pages).
Platt, "Method and System for Lining Multilateral Wells," U.S. Appl. No. 10/772,/841, Feb. 5, 2004 (30 pages).
Zupanick, "System And Method For Directional Drilling Utilizing Clutch Assembly," U.S. Appl. No. 10/811,118, Mar. 25, 2004 (35 pages).
Zupanick et al., "Slot Cavity," U.S. Appl. No. 10/419,529, Apr. 21, 2003 (44 pages).
Zupanick, "System And Method for Multiple Wells from a Common Surface Location," U.S. Appl. No. 10/788,694, Feb. 27, 2004 (26 pages).
Field, T.W., "*Surface to In-seam Drilling—The Australian Experience*," Undated, 10 pages.
Drawings included in CBM well permit issued to CNX stamped Apr. 15, 2004 by the West Virginia Department of Environmental Protection (5 pages).
Website of Mitchell Drilling Contractors, "*Services: Dymaxion—Surface to In-seam*," http://www.mitchell drilling.com/dymaxion.htm, printed as of Jun. 17, 2004, 4 pages.
Website of CH4, "About Natural Gas—Technology," http://www.ch4.com.au/ng_technology.html, copyright 2003, printed as of Jun. 17, 2004, 4 pages.
Thomson, et al., "*the Application of Medium Radius Directional Drilling for Coal Bed Methane Extraction*," Lucas Technical Paper, copyrighted 2003, 11 pages.
U.S. Department of Energy, DE-FC26-01NT41148, "*Enhanced Coal Bed Methane Production and Sequestration of CO2 in Unmineable Coal Seams*" for Consol, Inc., accepted Oct. 1, 2001, 48 pages.
U.S. Department of Energy, "*Slant Hole Drilling*," Mar. 1999, 1 page.
Desai, Praful, et al., "*Innovative Design Allows Construction of Level 3 or Level 4 Junction Using the Same Platform*," SPE/Petroleum Society of CIM/CHOA 78965, Canadian Heavy Oil Association, 2002, pp. 1-11.
Bybee, Karen, "*Advanced Openhole Multilaterals*," Horizontal Wells, Nov. 2002, pp. 41-42.
Bybee, Karen, "*A New Generation Multilateral System for the Troll Olje Field*," Multilateral/Extended Reach, Jul. 2002, 2 pages.
Emerson,, A.B., et al., "*Moving Toward Simpler, Highly Functional Multilateral Completions*," Technical Note, Journal of Canadian Petroleum Technology, May 2002, vol. 41, No. 5, pp. 9-12.
Moritis, Guntis, "*Complex Well Geometries Boost Orinoco Heavy Oil Producing Rates*," XP-000969491, Oil & Gas Journal, Feb. 28, 2000, pp. 42-46.
Themig, Dan, "*Multilateral Thinking*," New Technology Magazine, Dec. 1999, pp. 24-25.
Smith, R.C., et al., "*The Lateral Tie-Back System: The Ability to Drill and Case Multiple Laterals*," IADC/SPE 27436, Society of Petroleum Engineers, 1994, pp. 55-64, plus Multilateral Services Profile (1 page) and Multilateral Services Specifications (1 page).
Notification of Transmittal of the International Search Report or the Declaration (PCT Rule 44.1) (3 pages) and International Search Report (4 pages) re International Application No. PCT/US 03/13954 mailed Sep. 1, 2003.
Logan, Terry L., "*Drilling Techniques for Coalbed Methane*," Hydrocarbons From Coal, Chapter 12, Copyright 1993, Title Page, Copyright Page, pp. 269-285.
Hanes, John, "*Outbursts in Leichhardt Colliery: Lessons Learned*," International Symposium-Cum-Workshop on Management and Control of High Gas Emissions and Outbursts in Underground Coal Mines, Wollongong, NSW, Australia, Mar. 20-24, 1995, Title page, pp. 445-449.
Williams, Ray, et al., "*Gas Reservoir Properties for Mine Gas Emission Assessment*," Bowen Basin Symposium 2000, pp. 325-333.
Brown, K., et al., "*New South Wales Coal Seam Methane Potential*," Petroleum Bulletin 2, Department of Mineral Resources, Discovery 2000, Mar. 1996, pp. i-viii, 1-96.
Fipke, S., et al., "*Economical Multilateral Well Technology for Canadian Heavy Oil*," Petroleum Society, Canadian Institute of Mining, Metallurgy & Petroleum, Paper 2002-100, to be presented in Calgary Alberta, Jun. 11-13, 2002, pp. 1-11.
Notification of Transmittal of the International Search Report or the Declaration (PCT Rule 44.1) mailed Feb. 9, 2004 (6 pages) re International Application No. PCT/US 03/28138, Sep. 9, 2003.
Notification of Transmittal of the International Search Report or the Declaration (PCT Rule 44.1) mailed Feb. 27, 2004 (9 pages) re International Application No. PCT/US 03/30126, Sep. 23, 2003.
Fletcher, "Anadarko Cuts Gas Route Under Canadian River Gorge," Oil and Gas Journal, pp. 28-30, Jan. 25, 2004.
Translation of selected pages of Kalinin, et al., "Drilling Inclined and Horizontal Well Bores," Nedra Publishers, Moscow, 1997, 15 pages.
Translation of selected pages of Arens, V.Zh., "Well-Drilling Recovery of Minerals," Geotechnology, Nedra Publishers, Moscow, 7 pages, 1986.
PowerPoint Presentation entitled, "Horizontal Coalbed Methane Wells," by Bob Stayton, Computalog Drilling Services, date is believed to have been in 2002 (39 pages).
Denney, Dennis, "*Drilling Maximum-Reservoir-Contact Wells in the Shaybah Field*,"SPE 85307, pp. 60, 62-63, Oct. 20, 2003.
Notification of Transmittal of the International Search Report and the Written Opinion of the International Searching Authority, or the Declaration (3 pages), International Search Report (5 pages) and Written Opinion of the International Searching Authority (6 pages) re International Application No. PCT/US2004/012029 mailed Sep. 22, 2004.

Brunner, D.J. and Schwoebel, J.J., "Directional Drilling for Methane Drainage and Exploration in Advance of Mining," REI Drilling Directional Underground, World Coal, 1999, 10 pages.
Thakur, P.C., "A History of Coalbed Methane Drainage From United States Coal Mines," 2003 SME Annual Meeting, Feb. 24-26, Cincinnati, Ohio, 4 pages.
U.S. Climate Change Technology Program, "Technology Options for the Near and Long Term," 4.1.5 Advances in Coal Mine Methane Recovery Systems, pp. 162-164.
Notification of Transmittal of the International Search Report and the Written Opinion of the International Searching Authority, or the Declaration (3 pages), International Search Report (3 pages) and Written Opinion of the International Searching Authority (7 pages) re International Application No. PCT/US2004/017048 mailed Oct. 21, 2004.
Gardes, Robert, "Multi-Seam Completion Technology," Natural Gas Quarterly, E&P, Jun. 2004, pp. 78-81.
Baiton, Nicholas, "Maximize Oil Production and Recovery," Vertizontal Brochure, received Oct. 2, 2002, 4 pages.
Dreiling, Tim, McClelland, M.L. and Bilyeu, Brad, "Horizontal & High Angle Air Drilling in the San Juan Basin, New Mexico," Dated on or about Mar. 6, 2003, pp. 1-11.
Fong, David K., Wong, Frank Y., and McIntyre, Frank J., "An Unexpected Benefit of Horizontal Wells on Offset Vertical Well Productivity in Vertical miscible Floods," Canadian SPE/CIM/CANMET Paper No. HWC94-09, paper to be presneted Mar. 20-23, 1994, Calgary, Canada, 10 pages.
Fischer, Perry A., "What's Happening in Production," World Oil, Jun. 2001, p. 27.
Website of PTTC Network News vol. 7, 1st Quarter 2001, Table of Contents, http://www.pttc.org/.../news/v7n1nn4.htm printed Apr. 25, 2003, 3 pages.
Cox, Richard J.W., "Testing Horizontal Wells While Drilling Underbalanced," Delft University of Technology, Aug. 1998, 68 pages.
McLennan, John, et al., "Underbalanced Drilling Manual," Gas Research Institute, Chicago, Illinois, GRI Reference No. GRI-97/0236, copyright 1997, 502 pages.
The Need for a Viable Multi-Seam Completion Technology for the Powder River Basin, Current Practice and Limitations, Gardes Energy Services, Inc., Believed to be 2003 (8 pages).
Langley, Diane, "Potential Impact of Microholes Is Far From Diminutive," JPT Online, http://www.spe.org/spe/jpt/jps, Nov. 2004 (5 pages).
Consol Energy Slides, "Generating Solutions, Fueling Change," Presented at Appalachian E&P Forum, Harris Hesbitt Corp., Boston, Oct. 14, 2004 (29 pages).
Notification of Transmittal of the International Search Report and the Written Opinion of the International Searching Authority, or the Declaration (3 pages), International Search Report (3 pages), and Written Opinion of the International Searching Authority (5 pages) re International Application No. PCT/US2004/024518 mailed Nov. 10, 2004.
Schenk, Christopher J., "Geologic Definition and Resource Assessment of Continuous (Unconventional) Gas Accumulations—the U.S. Experience," Website, http://aapg.confex.com/...//, printed Nov. 16, 2004 (1 page).
U.S. Department of Interior, U.S. Geological Survey, "Characteristics of Discrete and Basin-Centered Parts of the Lower Silurian Regional Oil and Gas Accumulation, Appalachian Basin: Preliminary Results From a Data Set of 25 oil and Gas Fields," U.S. Geological Survey Open-File Report 98-216, Website, http://pubs.usgs.gov/of/1998/of98-216/introl.htm, printed Nov. 16, 2004 (2 pages).
Zupanick, J., "Coalbed Methane Extraction," 28th Mineral Law Conference, Lexington, Kentucky, Oct. 16-17, 2003 (48 pages).
Zupanick, J., "CDX Gas—Pinnacle Project," Presentation at the 2002 Fall Meeting of North American Coal Bed Methane Forum, Morgantown, West Virginia, Oct. 30, 2002 (23 pages).
Lukas, Andrew, Lucas Drilling Pty Ltd., "Technical Innovation and Engineering Xstrata—Oaky Creedk Coal Pty Limited," Presentation at Coal Seam Gas & Mine Methane Conference in Brisbane, Nov. 22-23, 2004 (51 pages).
Field, Tony, Mitchell Drilling, "Let's Get Technical—Drilling Breakthroughs in Surface to In-Seam in Australia," Presentation at Coal Seam Gas & Mine Methane Conference in Brisbane, Nov. 22-23, 2004 (20 pages).
Zupanick, Joseph A, "Coal Mine Methane Drainage Utilizing Multilateral Horizontal Wells," 2005 SME Annual Meeting & Exhibit, Feb. 28-Mar. 2, 2005, Salt Lake City, Utah (6 pages).
The Official newsletter of the Cooperative Research Centre for Mining Technology and Equipment, CMTE News 7, "Tight-Radius Drilling Clinches Award," Jun. 2001, 1 page.
Gardes Directional Drilling, "Multiple Directional Wells From Single Borehole Developed," Reprinted from Jul. 1989 edition of Offshore, Copyright 1989 by PennWell Publishing Company (4 pages).
"Economic Justification and Modeling of Multilateral Wells," Economic Analysis, Hart's Petroleum Engineer International, 1997 (4 pages).
Mike Chambers, "Multi-Lateral Completions at Mobil Past, Present, and Future," presented at the 1998 Summit on E&P Drilling Technologies, Strategic Research Institute, Aug. 18-19, 1998 in San Antonio, Texas (26 pages).
David C. Oyler and William P. Diamond, "Drilling a Horizontal Coalbed Methane Drainage System From a Directional Surface Borehole," PB82221516, National Technical Information Service, Bureau of Mines, Pittsburgh, PA, Pittsburgh Research Center, Apr. 1982 (56 pages).
P. Corlay, D. Bossie-Codreanu, J.C. Sabathier and E.R. Delamaide, "Improving Reservoir Management With Complex Well Architectures," Field Production & Reservoir Management, World Oil, Jan. 1997 (5 pages).
Eric R. Skonberg and Hugh W. O'Donnell, "Horizontal Drilling for Underground Coal Gasification," presented at the Eighth Underground Coal Conversion Sysmposium, Keystone, Colorado, Aug. 16, 1982 (8 pages).
Gamal Ismail, A.S. Fada'q, S. Kikuchi, H. El Khatib, "Ten Years Experience in Horizontal Application & Pushing the Limits of Well Construction Approach in Upper Zakum Field (Offshore Abu Dhabi)," SPE 87284, Society of Petroleum Engineers, Oct. 2000 (17 pages).
Gamal Ismail, H. El-Khatib—ZADCO, Abu Dhabi, UAE, "Multi-Lateral Horizontal Drilling Problems & Solutions Experienced Offshore Abu Dhabi," SPE 36252, Society of Petroleum Engineers, Oct. 1996 (12 pages).
C.M. Matthews and L.J. Dunn, "Drilling and Production Practices to Mitigate Sucker Rod/Tubing Wear-Related Failures in Directional Wells," SPE 22852, Society of Petroleum Engineers, Oct. 1991 (12 pages).
H.H. Fields, Stephen Krickovic, Albert Sainato, and M.G. Zabetakis, "Degasification of Virgin Pittsburgh Coalbed Through a Large Borehole," RI-7800, Bureau of Mines Report of Investigations/1973, United States Department of the Interior, 1973 (31 pages).
William P. Diamond, "Methane Control for Underground Coal Mines," IC-9395, Bureau of Mines Information Circular, united States Department of the Interior, 1994 (51 pages).
Technology Scene Drilling & Intervention Services, "Weatherford Moves Into Advanced Multilateral Well Completion Technology," *Reservoir Mechanics*, Weatherford International, Inc., 2000 Annual Report (2 pages).
"A Different Direction for CBM Wells," *W Magazine*, 2004 Third Quarter (5 pages).
Snyder, Robert E., What's New in Production, *WorldOil Magazine*, Feb. 2005, [retrieved from the internet on Mar. 7, 2005], http://www.worldoil.com/magazine/MAGAZINE_DETAIL.asp?ART_ID=2507@MONTH_YEAR (3 pages).
Nazzal, Greg, "Moving Multilateral Systems to the Next Level," Strategic Acquisition Expands Weatherford's Capabilities, 2000 (2 pages).
Dreiling, Tim, McClelland, M.L. and Bilyeu, Brad, "Horizontal & High Angle Air Drilling in the San Juan Basin, New Mexico," Believed to be dated Apr. 1996, pp. 1-11.
Technology Scene Drilling & Intervention Services, "Weatherford Moves Into Advanced Multilateral Well Completion Technology"

and "Producttivity Gains and Safety Record Speed Acceptance of UBS," *Reservoir Mechanics*, Weatherford International, Inc., 2000 Annual Report (2 pages).

Bahr, Angie, "Methane Draining Technology Boosts Safety and Energy Production," Energy Review, Feb. 4, 2005, Website: www.energyreview.net/storyviewprint.asp, printed Feb. 7, 2005 (2 pages).

Molvar, Erik M., "Drilling Smarter: Using Directional Drilling to Reduce Oil and Gas Impacts in the Intermountain West," Prepared by Biodiversity Conservation Alliance, Report issued Feb. 18, 2003, 34 pages.

King, Robert F., "Drilling Sideways—A Review of Horizontal Well Technology and Its Domestic Application," DOE/EIA-TR-0565, U.S. Department of Energy, Apr. 1993, 30 pages.

Santos, Helio, SPE Impact Engineering Solutions and Jesus Olaya, Ecopetrol/ICP, "*No-Damage Drilling: How to Achieve this Challenging Goal?*," SPE 77189, Copyright 2002, presented at the IADC/SOE Asia Pacific Drilling Technology, Jakarta, indonesia, Sep. 9-11, 2002, 10 pages.

Santos, Helio, SPE, Impact Engineering Solutions, "*Increasing Leakoff Pressure with New Class of Drilling Fluid*," SPE 78243, Copyright 2002, presented at the SPE/ISRM Rock Mechanics Conference in Irving, Texas, Oct. 20-23, 2002, 7 pages.

Frank Labenski, Paul Reid, SPE, and Helio Santos, SPE, Impact Solutions Group, "*Drilling Fluids Approaches for Control of Wellbore Instability in Fractured Formations*," SPE/IADC 85304, Society of Petroleum Engineers, Copyright 2003, presented at the SPE/IADC Middle East Drilling Technology Conference & Exhibition in Abu Chabi, UAE, Oct. 20-22, 2003, 8 pages.

P. Reid, SPE, and H. Santos, SPE, Impact Solutions Group, "*Novel Drilling, Completion and Workover Fluids for Depleted Zones: Avoiding Losses, Formation Damage and Stuck Pipe*," SPE/IADC 85326, Society of Petroleum Engineers, Copyright 2003, presented at the SPE/IADC Middle East Drilling Conference & Exhibition in Abu Chabi, UAE, Oct. 20-22, 2003, 9 pages.

Craig C. White and Adrian P. Chesters, NAM; Catalin D. Ivan, Sven Maikranz and Rob Nouris, M-I L.L.C., "*Aphron-based drilling fluid: Novel technology for drilling depleted formations*," World Oil, Drilling Report Special Focus, Oct. 2003, 5 pages.

Robert E. Snyder, "Drilling Advances," World Oil, Oct. 2003, 1 page.

U.S. Environmental Protection Agency, "Directional Drilling Technology," prepared for the EPA by Advanced Resources International under Contract 68-W-00-094, Coalbed Methane Outreach Program (CMOP), published Dec. 2002, Website: http://search.epa.gov/s97is.vts, printed Mar. 17, 2005, 13 pages.

"Meridian Tests New Technology," Western Oil World, Jun. 1990, Cover, Table of Contents and p. 13.

Clint Leazer and Michael R. Marquez, "Short-Radius Drilling Expands Horizontal Well Applications," Petroleum Engineer International, Apr. 1995, 6 pages.

Terry R. Logan, "Horizontal Drainhole Drilling Techniques Used in Rocky Mountains Coal Seams," Geology and Coal-Bed Methane Resources of the Northern San Juan Basin, Colorado and New Mexico, Rocky Mountain Association of Geologists, Coal-Bed Methane, San Juan Basin, 1988, pp. cover, 133-142.

Daniel J.Brunner, Jeffrey J. Schwoebel, and Scott Thomson, "Directional Drilling for Methane Drainage & Exploration in Advance of Mining," Website: httP://www.advminingtech.com.au/Paper4.htm, printed Apr. 6, 2005, Copyright 1999, Last modified Aug. 7, 2002, (8 pages).

Karen Bybee, highlights of paper SPE 84424, "Coalbed-Methane Reservoir Simulation: An Evolving Science," by T.L. Hower, JPT Online, Apr. 2004, Website: http://www.spe.org/spe/jpt/jsp/jptpapersynopsis/0,2439,1104_11038_2354946_2395832,00.html, printed Apr. 14, 2005, 4 pages.

Kevin Meaney and Lincoln Paterson, "Relative Permeability in Coal," SPE 36986, Society of Petroleum Engineers, Copyright 1996, pp. 231-236.

Calendar of Events—Conference Agenda, Fifth Annual Unconventional Gas and Coalbed Methane Conference, Oct. 22-24, 2003, in Calgary Alberta, Website: http://www.csug.ca/cal/calc0301a.html, printed Mar. 17, 2005, 5 pages.

Tom Engler and Kent Perry, "Creating a Roadmap for Unconventional Gas R&D," Gas TIPS, Fall 2002, pp. 16-20.

CSIRO Petroleum—SIMEDWin, "Summary of SIMEDWin Capabilities," Copyright 1997-2005, Website: http://www.dpr.csiro.au/ourcapabilities/petroleumgeoengineering/reservoirengineering/projects/simedwin/assets/simed/index.html, printed Mar. 17, 2005, 10 pages.

Solutions From the Field, "Coalbed Methane Resources in the Southeast," Copyright 2004, Website: http://www.pttc.org/solutions/sol_2004/537.htm, printed Mar. 17, 2005, 7 pages.

Jeffrey R. Levine, Ph.D., "Matrix Shrinkage Coefficient," Undated, 3 pages.

G. Twombly, S.H. Stepanek, T.A. Moore, Coalbed Methane Potential in the Waikato Coalfield of New Zealand: A Comparison With Developed Basins in the United States, 2004 New Zealand Petroleum Conference Proceedings, Mar. 7-10, 2004, pp. 1-6.

R.W. cade, "Horizontal Wells: Development and Applications," Presented at the Fifth International Symposium on Geophysics for Mineral, Geotechnical and Environmental Applications, Oct. 24-28, 1993 in Tulsa, Oklahoma, Website: http://www.mgls.org/93Sym/Cade/cade.html, printed Mar. 17, 2005, 6 pages.

Solutions From the Field, "Horizontal Drilling, A Technology Update for the Appalachian Basin," Copyright 2004, Website: http://www.pttc.org/solutions/sol_2004/535.htm, printed Mar. 17, 2005, 6 pages.

P. Purl, J.C. Evanoff and M.L. Brugler, "Measurement of Coal Cleat Porosity and Relative Permeability Characteristics," SPE 21491, Society of Petroleum Engineers, Copyright 1991, pp. 93-104.

Peter Jackson, "Drilling Technologies for Underground Coal Gasification," IMC Geophysics Ltd., International UCG Workshop—Oct. 2003 (20 pages).

Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/002162 mailed Apr. 22, 2005.

Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/005289 mailed Apr. 29, 2005.

Notification of Transmittal of the International Search Report and the Written Opinion of the International Searching Authority, or the Declaration (3 pages), International Search Report (5 pages) and Written Opinion of the International Searching Authority (5 pages) re International Application No. PCT/US2004/036616 mailed Feb. 24, 2005.

Notification of Transmittal of International Preliminary Examination Report (1 page) and International Preliminary Examination Report (3 pages) for International Application No. PCT/US03/13954 mailed Apr. 14, 2005.

Notification of Transmittal of International Preliminary Examination Report (1 page) and International Preliminary Examination Report (5 pages) mailed Jan. 18, 2005 and Written Opinion (8 pages) mailed Aug. 25, 2005 for International Application No. PCT/US03/30126.

Notification of Transmittal of the International Search Report or the Declaration (3 pages) and International Search Report (5 pages) mailed Nov. 10, 2000 for International Application No. PCT/US99/27494.

Notification of Transmittal of International Preliminary Examination Report (1 page) and International Preliminary Examination Report (6 pages) mailed Apr. 2, 2001 and Written Opinion mailed Sep. 27, 2000 for International Application No. PCT/US99/27494.

Notification of Transmittal of the International Search Report or the Declaration (3 pages) and International Search Report (5 pages) mailed Jun. 6, 2002 for International Application No. PCT/US02/02051.

Notification of Transmittal of the International Search Report or the Declaration (3 pages) and International Search Report (6 pages) mailed Mar. 13, 2003 for International Application No. PCT/US02/33128.
Notification of Transmittal of International Preliminary Examination Report (1 page) and International Preliminary Examination Report (3 pages mailed Apr. 22, 2004 and Written Opinion mailed Sep. 4, 2003 for International Application No. PCT/US02/33128.
Notes on Consol Presentation (by P. Thakur) made at IOGA PA in Pittsburgh, Pennsylvania on May 22, 2002 (3 pages).
Notification of Transmittal of the International Preliminary Report of Patentability (1 page) and International Preliminary Report on Patentability (12 pages) mailed Jan. 9, 2006 for International Application No. PCT/US2004/036616.
Notification Concerning Transmittal of Copy of International Preliminary Report on Patentability (Chapter 1 of the Patent Cooperation Treaty) (1 page), International Preliminary Report on Patentability (1 page), and Written Opinion of the International Searching Authority (7 pages) mailed Dec. 22, 2005 for International Application No. PCT/US2004/017048.
European Search and Examination Report, completed Dec. 5, 2005 for Application Number EP 05020737, 5 pages.
P.C. Thakur and W.N. Poundstone, "Horizontal Drilling Technology for Advance Degasification," Society of Mining Engineers of AIME, Preprint No. 79-113, For presentation at the 1979 AIME Annual Meeting, New Orleans, Lousiana, Feb. 18-22, 1979, Engineering Societies Library stamp dated Feb. 5, 1980, 11 pages.
Notification Concerning Transmittal of Copy of International Preliminary Report on Patentability (1 page), International Preliminary Report on Patentability (1 page), and Written Opinion of the International Searching Authority (5 pages) mailed Feb. 9, 2006 for International Application No. PCT/US2004/024518.
Wang Weiping, "Trend of Drilling Technology Abroad," Petroleum Drilling and Production Technology, 1995 (vol. 17), Issue 6, www.cnki.net, 8 pages.
Tver, David, *The Petroleum Dictionary*, 1980, p. 221.
Rennick, et al., "Demonstration of Safety Plugging of Oil Wells Penetrating Appalachian Coal Mines," Bureau of Mines Coal Mine Health and Safety Research Program, Technical Progress Report—56, U.S. Department of the Interior, Jul. 1972, 25 pages.
George N. Aul and Joseph Cervik, Grouting Horizontal Drainage Holes in Coalbeds, RI 8375, Bureau of Mines Report of Investigations, U.S. Department of the Interior, 1979, 21 pages.
Paul J. Componation, et al., "Cleaning Out, Sealing and Mining Through Wells Penetrating Areas of Active Coal Mines In Northern West Virginia," MESA Information Report 1052, 1977, 26 pages.
George S. Rice, "Notes on the Prevention of Dust and Gas Explosions in Coal Mines," Technical Papter 56, Department of the Interior Bureau of Mines, copyright 1913, 12 pages.
George S. Rice, et al., "Oil and Gas Wells Through Workable Coal Beds," Bulletin 65, Petroleum Technology 7, Bureau of Mines Internal Industries, copyright 1913, 54 pages.

* cited by examiner 230
210
260
262
264
250
268
PUMP
252
272
270
266
214
212
258
256
220
215
254
222

METHOD AND SYSTEM FOR RECIRCULATING FLUID IN A WELL SYSTEM

TECHNICAL FIELD OF THE INVENTION

The present invention relates generally to systems and methods for the recovery of subterranean resources and, more particularly, to a method and system for recirculating fluid in a well system.

BACKGROUND OF THE INVENTION

Subterranean deposits of coal, also referred to as coal seams, contain substantial quantities of entrained methane gas. Other types of formations, such as shale, similarly contain entrained formation gases. Production and use of these formation gases from coal deposits and other formations has occurred for many years. Substantial obstacles, however, have frustrated more extensive development and use of gas deposits in subterranean formations.

One recently developed technique for producing formation gases is the use of a dual well system including a vertical well bore that is drilled from the surface to the subterranean formation and an articulated well bore that is drilled offset from the vertical well bore at the surface, that intersects the vertical well bore proximate the formation, and that extends substantially horizontally into the formation. This horizontal well bore extending into the formation may then be used to drain formation gases and other fluids from the formation. A drainage pattern may also be formed from the horizontal well bore to enhance drainage. These drained fluids may then be produced up the vertical well bore to the surface.

Although such a dual well system may significantly increase production of formation gases and fluids, some problems may arise in association with the use of such a system. Such problems may include surging of gases being produced and build-up of particles from the formation (such as coal fines), both of which may reduce the efficiency of production from the dual well system. Such problems may also occur with single well systems.

SUMMARY OF THE INVENTION

The present invention provides a method and system for recirculating fluid in a well system that substantially eliminates or reduces at least some of the disadvantages and problems associated with previous methods and systems.

In accordance with a particular embodiment of the present invention, a method for recirculating fluid in a well system includes drilling a first well bore from a surface to a subterranean zone, and drilling an articulated well bore that is horizontally offset from the first well bore at the surface and that intersects the first well bore at a junction proximate the subterranean zone. The method also includes drilling a drainage bore from or into the junction into the subterranean zone, and receiving gas, water, and particles produced from the subterranean zone at the junction via the drainage bore. The gas, water, and particles are received from the junction at the surface, and the water is separated from the gas and the particles. The method also includes determining an amount of water to circulate, and recirculating a portion of the separated water according to this determination.

Technical advantages of particular embodiments of the present invention include a method and system for recirculating fluid in a single or multi-well system. This recirculation allows management of the bottom hole pressure in the well system. This bottom hole pressure may be maintained by recirculating an appropriate amount of water produced from the well system to create an appropriate hydrostatic head of water that maintains the desired bottom hole pressure. Furthermore, the increased fluid velocity resulting from the recirculated water may assist in the removal of particles produced in the system to the surface.

Other technical advantages will be readily apparent to one skilled in the art from the figures, descriptions and claims included herein. Moreover, while specific advantages have been enumerated above, various embodiments may include all, some or none of the enumerated advantages.

BRIEF DESCRIPTION OF THE DRAWINGS

For a more complete understanding of particular embodiments of the invention and their advantages, reference is now made to the following descriptions, taken in conjunction with the accompanying drawings, in which.

DETAILED DESCRIPTION OF THE INVENTION

Figure 1:
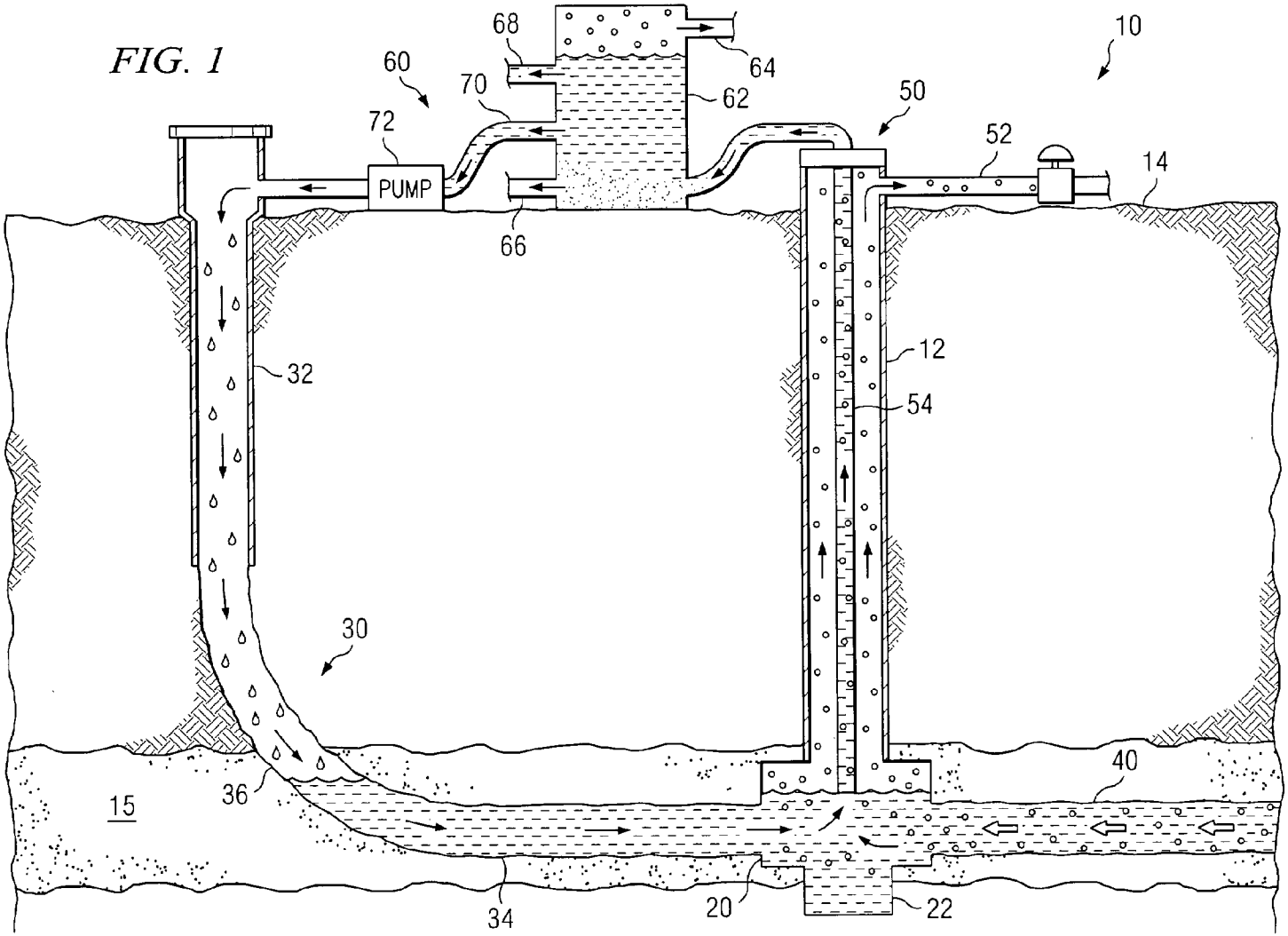
FIG. 1 illustrates an example multi-well system using recirculation of produced fluid in accordance with an embodiment of the present invention.

FIG. 1 illustrates an example multi-well system 10 for production of fluids from a subterranean, or subsurface, zone in accordance with one embodiment of the present invention. In this embodiment, the subterranean zone is a coal seam, from which coal bed methane (CBM) gas, entrained water and other fluids are produced to the surface. However, the multi-well system 10 may be used to produce fluids from any other suitable subterranean zones, such as other formations or zones including hydrocarbons. Furthermore, although a particular arrangement of wells is illustrated, other suitable types of single, dual or multi-well systems having intersecting and/or divergent bores or other wells may be used to access the coal seam or other subterranean zone. In other embodiments, for example, vertical, slant, horizontal or other well systems may be used to access subterranean zones.

Referring to FIG. 1, the multi-well system 10 includes a first well bore 12 extending from the surface 14 to a target coal seam 15. The first well bore 12 intersects the coal seam 15 and may continue below the coal seam 15. The first well bore 12 may be lined with a suitable well casing that terminates at or above the level of the coal seam 15. The first well bore 12 may be vertical, substantially vertical, straight, slanted and/or otherwise appropriately formed to allow fluids to be pumped or otherwise lifted up the first well bore 12 to the surface 14. Thus, the first well bore 12 may include suitable angles to accommodate surface 14 characteristics, geometric characteristics of the coal seam 15, characteristics of intermediate formations and/or may be slanted at a suitable angle or angles along its length or parts of its length.

A cavity 20 is disposed in the first well bore 12 proximate to the coal seam 15. The cavity 20 may thus be wholly or partially within, above or below the coal seam 15 or otherwise in the vicinity of the coal seam 15. A portion of the first well bore 12 may continue below the enlarged cavity 20 to form a sump 22 for the cavity 20.

The cavity 20 may provide a point for intersection of the first well bore 12 by a second, articulated well bore 30 used to form a horizontal, multi-branching or other suitable subterranean well bore pattern in the coal seam 15. The cavity 20 may be an enlarged area of either or both of well bores 12 and 30 or an area connecting the well bores 12 and 30 and may have any suitable configuration. The cavity 20 may also provide a collection point for fluids drained from the coal seam 15 during production operations and may additionally function as a surge chamber, an expansion chamber and the like. In another embodiment, the cavity 20 may have an enlarged substantially rectangular cross section perpendicular to the articulated well bore 30 for intersection by the articulated well bore 30 and a narrow depth through which the articulated well bore 30 passes. In still other embodiments, the cavity 20 may be omitted and the wells may intersect to form a junction or may intersect at any other suitable type of junction.

The second, articulated well bore 30 extends from the surface 14 to the cavity 20 of the first well bore 12. The articulated well bore 30 may include a substantially vertical portion 32, a substantially horizontal portion 34, and a curved or radiused portion 36 interconnecting the portions 32 and 34. The substantially vertical portion 32 may be formed at any suitable angle relative to the surface 14 to accommodate geometric characteristics of the surface 14 or the coal seam 15. The substantially vertical portion 32 may be lined with a suitable casing.

The substantially horizontal portion 34 may lie substantially in the plane of the coal seam 15 and may be formed at any suitable angle relative to the surface 14 to accommodate the dip or other geometric characteristics of the coal seam 15. In one embodiment, the substantially horizontal portion 34 intersects the cavity 20 of the first well bore 12. In this embodiment, the substantially horizontal portion 34 may undulate, be formed partially or entirely outside the coal seam 15 and/or may be suitably angled. In another embodiment, the curved or radius portion 36 of the articulated well 30 may directly intersect the cavity 20.

In particular embodiments, the articulated well bore 30 may be offset a sufficient distance from the first well bore 12 at the surface 14 to permit a large radius of curvature for portion 36 of the articulated well 30 and any desired length of portion 34 to be drilled before intersecting the cavity 20. For a curve with a radius of 100–140 feet, the articulated well bore 30 may be offset a distance of about 300 feet at the surface from the first well bore 12. This spacing reduces or minimizes the angle of the curved portion 36 to reduce friction in the articulated well bore 30 during drilling operations. As a result, the reach of the drill string through the articulated well bore 30 is increased and/or maximized. In another embodiment, the articulated well bore 30 may be located within close proximity of the first well bore 12 at the surface 14 to minimize the surface area for drilling and production operations. In this embodiment, the first well bore 12 may be suitably sloped or radiused to accommodate the large radius of the articulated well 30.

A drainage well bore or drainage pattern 40 (only a portion of which is illustrated) may extend from the cavity 20 into the coal seam 15 or may be otherwise coupled to the well bores 12 and/or 30. The drainage pattern 40 may be entirely or largely disposed in the coal seam 15. The drainage pattern 40 may be substantially horizontal corresponding to the geometric characteristics of the coal seam 15. Thus, the drainage pattern 40 may include sloped, undulating, or other inclinations of the coal seam 15.

In one embodiment, the drainage pattern 40 may be formed using the articulated well bore 30 and drilling through the cavity 20. In other embodiments, the first well bore 12 and/or cavity 20 may be otherwise positioned relative to the drainage pattern 40 and the articulated well 30. For example, in one embodiment, the first well bore 12 and cavity 20 may be positioned at an end of the drainage pattern 40 distant from the articulated well 30. In another embodiment, the first well bore 12 and cavity 20 may be positioned within the pattern 40 at or between sets of laterals. In addition, the substantially horizontal portion 34 of the articulated well may have any suitable length and itself form the drainage pattern 40 or a portion of the pattern 40.

The drainage pattern 40 may simply be the drainage well bore or it may be an omni-directional pattern operable to intersect a substantial or other suitable number of fractures in the area of the coal seam 15 covered by the pattern 40. The omni-direction pattern may be a multi-lateral, multi-branching pattern, other pattern having a lateral or other network of bores or other pattern of one or more bores with a significant percentage of the total footage of the bores having disparate orientations. Such a drainage pattern may be formed from the drainage well bore.

The multi-well system 10 may be formed using conventional and other suitable drilling techniques. In one embodiment, the first well bore 12 is conventionally drilled and logged either during or after drilling in order to closely approximate and/or locate the vertical depth of the coal seam 15. The enlarged cavity 20 is formed using a suitable underreaming technique and equipment such as a dual blade tool using centrifugal force, ratcheting or a piston for actuation, a pantograph and the like. The articulated well bore 30 and drainage pattern 40 are drilled using a drill string including a suitable down-hole motor and bit. Gamma ray logging tools and conventional measurement while drilling (MWD) devices may be employed to control and direct the orientation of the bit and to retain the drainage pattern 40 within the confines of the coal seam 15 as well as to provide substantially uniform coverage of a desired area within the coal seam 15.

After well bores 12 and 30, and the drainage bore and/or pattern 40 have been drilled, the first well bore 12 and the articulated well bore 30 are capped. Production of water, gas and other fluids from the coal seam 15 may then occur, in the illustrated embodiment, through the first well bore 12 using gas and/or mechanical lift. In many coal seams, a certain amount of water has to be removed from the coal seam 15, to lower the formation pressure enough for the gas to flow out of the coal seam 15, before a significant amount of gas is produced from the coal seam 15. However, for some formations, little or no water may need to be removed before gas may flow in significant volumes. This water may be removed from the coal seam 15 by gas lift, pumping, or any other suitable technique.

After sufficient water has been removed from the coal seam 15 or the pressure of the coal seam 15 is otherwise lowered, coal seam gas may flow from the coal seam 15 to the surface 14 through the first well bore 12. This gas often flows from the coal seam 15 entrained in water (for example, in the form of a mist). As this gas and water mixture flows from the coal seam 15 and through the drainage pattern 40 to the first well bore 12, coal fines generated during drilling of the drainage pattern 40, coal particles from the walls of the bore holes comprising the drainage pattern 40, and/or other particles are carried with the gas/water mixture to the cavity 20. Some of these particles are carried by the gas/water mixture up the first well 12 to the surface 14. However, some of the particles settle in the cavity 20 and in the sump 22 and build-up over time. Furthermore, a decrease in the amount of water flowing from the coal seam (in which the particles are suspended) causes an increase in this build-up since there is less water to suspend the particles and carry them to the surface 14. This build-up of particles is detrimental to the production of gas from the coal seam 15 since this build-up hinders the flow of gas to the surface and reduces the portion of the cavity 20 which may be used as a sump to collect water produced from the coal seam 15.

Another issue that arises during the production of gas from the coal seam 15 is that the amount of gas flowing from the coal seam 15 is not constant, but rather includes intermittent "surges." Such surges also decrease the efficiency of gas production from the coal seam 15.

Figure 2:
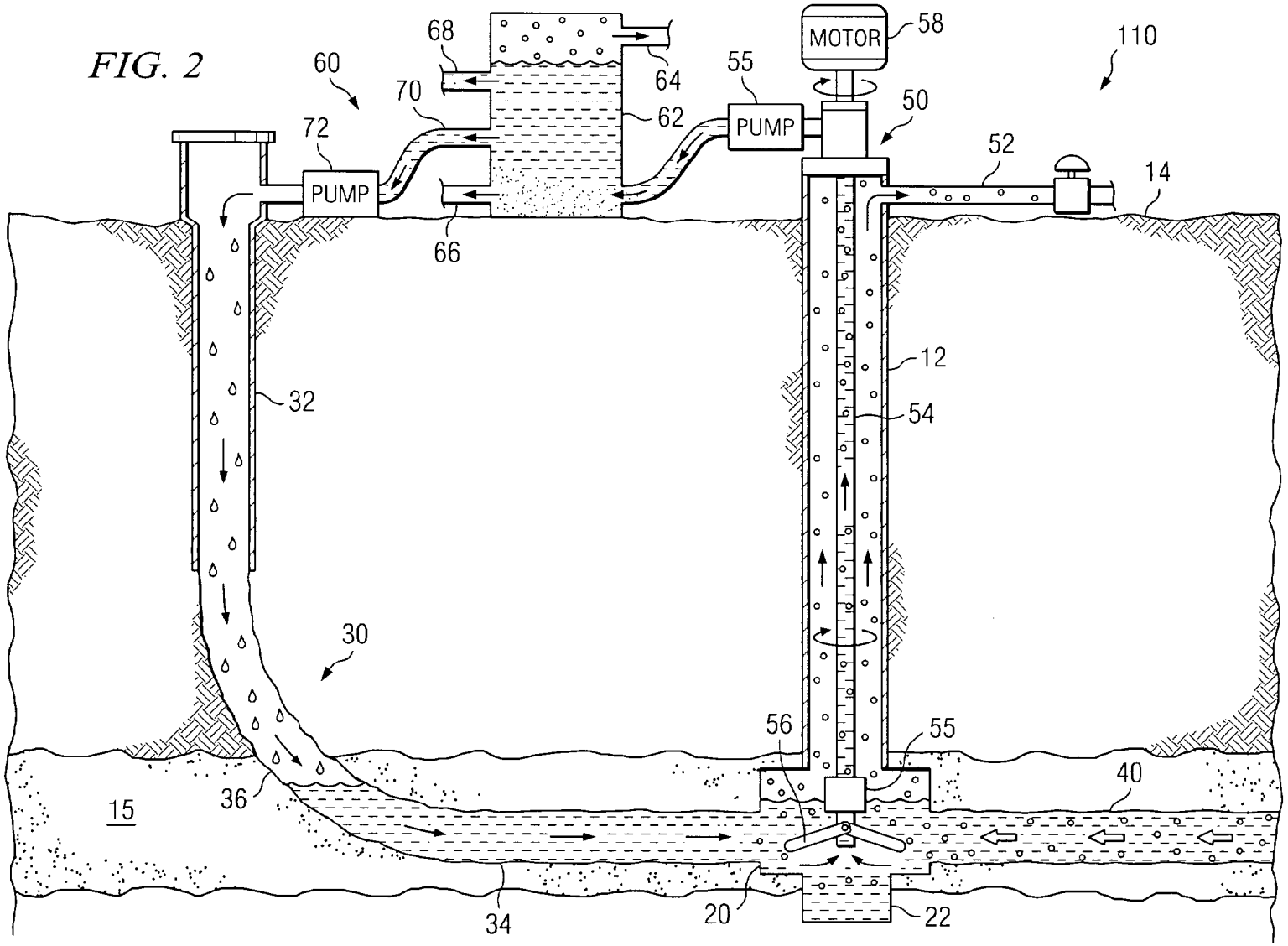
FIG. 2 illustrates an example multi-well system using recirculation of produced fluid in accordance with another embodiment of the present invention.

To address these issues, the multi-well system 10 includes a water separation/recirculation system 60. Some of the gas produced from the coal seam 15 may be separated in the cavity 20 from any produced water. This separated gas flows to the surface 14 via the first well 12 and is removed via a piping 52 attached to a wellhead apparatus 50. Other gas produced from the coal seam 15 remains entrained in the water that is produced from the coal seam 15. In the illustrated embodiment, this water and entrained gas (along with particles from the drainage pattern 40 and/or the cavity 20) are forced by the formation pressure in the coal seam 15 up a tubing 54 that extends from the cavity 20 up the first well and through the wellhead apparatus 50 to the separation/recirculation system 60. In many cases, all the gas will flow up tubing 54 with the water. The inlet of tubing 54 may preferably be placed at the water level in cavity 20 in certain embodiments. In an alternative embodiment, as illustrated in FIG. 2, the produced water may be pumped up the first well 12; however, in the embodiment illustrated in FIG. 1, sufficient gas is produced from the coal seam 15 to gas-lift the water to the surface 14.

The water, gas, and particles produced up tubing 54 are communicated to a gas/liquid/solid separator 62 that is included in the separation/recirculation system 60. This separator 62 separates the gas, the water, and the particles and lets them be dealt with separately. Although the term "separation" is used, it should be understood that complete separation may not occur. For example, "separated" water may still include a small amount of particles. Once separated, the produced gas may be removed via outlet 64 for further treatment (if appropriate), the particles may be removed for disposal via outlet 66, and the water may be removed via outlet 68 and/or outlet 70. Although a single separator 62 is shown, the gas may be separated from the water in one apparatus and the particles may be separated from the water in another apparatus. Furthermore, although a separation tank is shown, one skilled in the art will appreciate numerous different separation devices may be used and are encompassed within the scope of the present invention.

As described above, the separated water may be removed from the separator 62 via outlets 68 and/or 70. Water removed via outlet 68 is removed from multi-well system 10 and is piped to a appropriate location for disposal, storage, or other suitable uses. Water removed via outlet 70 is piped to a pump that directs the water, at a desired rate, back into system 10 through the articulated well bore 30. This recirculation of water may be used to address the particle build-up and surging issues described above. It will be understood that although two water outlets 68 and 70 are described, water may be removed from the separator 62 via a single outlet and then piped as necessary for disposal or recirculation.

The recirculated water produced from the coal seam 15 flows from the pump 72 down the articulated well bore 30 and into cavity 20. This recirculation of water may be used to add water to the cavity 20 to keep or place particles from the drainage pattern 40 in suspension so that they may be carried to the surface 14 via the first well bore 12. The recirculated water flowing down the articulated well bore 30 may also create turbulence in the cavity 20 to help stir up particles that have built-up in the cavity 20, so that they become suspended in the water. The pump 72 may be used to control the amount of water recirculated such that a near constant amount of water may flow up the first well bore 12 regardless of the amount of water produced from the coal seam 15 at a particular instant. In other words, the recirculated water may be used to make up for a lack of or a decrease in the amount of water coming from the coal seam 15, so that enough water is present in cavity 20 to remove a sufficient amount of particles to the surface 14.

The pump 72 may have an associated controller that determines how much water to recirculate based on readings from a water level or pressure sensor and that controls the rate of the pump 72 accordingly. Alternatively, the rate of water recirculation may be based on a measurement of the amount of solids in the produced water that is removed from the well. Moreover, although a pump is described, the water may be recirculated down the articulated well using compressed air or any other suitable techniques.

The recirculated water also may be used to regulate the bottom-hole pressure in the cavity 20 so as to maintain a constant or near-constant bottom-hole pressure. The bottom hole pressure may be controlled by controlling the water/gas ratio in tubing 54. A higher ratio of water to gas causes more friction an increases the pressure. This water/gas ratio may be varied by controlling the pump 72 so as to recirculate enough water from the separator 62 to maintain the desired ratio. The pump 72 may be so controlled by a controller and as associated water level or pressure sensor in the cavity 20. The desired amount of bottom hole pressure in the cavity 20 may be chosen so as to be a sufficient back pressure to control surges of gases from the drainage pattern.

Although the example multi-well system 10 illustrated in FIG. 1 pumps the recirculated water down the articulated well bore 30, this recirculated water may alternatively be pumped from the separator 62 down the first well bore 12. Moreover, although the example multi-well system 10 relies on gas-lift to bring the water and particles from the cavity 20 to the surface, other embodiments may use a pump to bring the water to the surface. Such an embodiment is described below.

FIG. 2 illustrates an example multi-well system 110 for production of fluids from a subterranean, or subsurface, zone in accordance with one embodiment of the present invention. As with system 10, system 110 includes a first well bore 12, a cavity 20, and an articulated well bore 30, which are formed as described above. System 110 also includes a separation/recirculation system 60, as described above, which separates water from the produced mixture of gas, water, and particles and recirculates a portion of the produced water down the articulated well bore 30. However, unlike system 10, system 110 uses a pump 55 to bring the produced water and particles to the surface 14 via tubing 54. As illustrated, the pump 55 may be located at the surface or down-hole. Such a system 110 may be used as an alternative to gas-lifting the water to the surface 14, as described above with reference to system 10.

The pump 55 may be a sucker rod pump, a Moineau pump, a progressive pump, or other suitable pump operable to lift fluids vertically or substantially vertically up the first well bore 12. The pump 55 may be operated continuously or as needed to remove water drained from the coal seam 15 into the cavity 20. The rate at which the pump 55 removes water from cavity 20 and the rate at which the pump 72 of the separation/recirculation system 60 recirculates water down the articulated well 30 may be adjusted in a complementary manner as is appropriate to provide a sufficient amount of water in the cavity 20 to suspend the produced particles and to provide an appropriate hydrostatic head, while also providing a flow of water from the cavity 20 to remove a sufficient amount of the particles from the cavity 20.

In the example multi-well system 110, the tubing 54 also includes stirring arms 56 that are pivotally coupled to the tubing 54 near the inlet of the tubing 54. Once the inlet of the tubing 54 is positioned in cavity 20, the tubing 54 may be rotated by a motor 58 at a sufficient speed to centrifugally extend the stirring arms 56. The tubing 54 may then be lowered such that at least a portion of the arms 56 are brought to rest on the bottom of the cavity 20, which causes the arms 56 to remain extended. Later, during pumping of water from the cavity 20 up the tubing 54, the motor 58 may then be used to slowly turn the tubing 54 and the stirring arms 56 to agitate any particles that have built-up in the cavity 20, so that the particles are caused to be suspended in the water and pumped to the surface 14. Motor 58 may rotate tubing 54 in such a manner either continuously or for any appropriate lengths of time during pumping and at any suitable speed.

Although the example multi-well system 110 illustrated in FIG. 2 pumps water up the first well bore 12 and recirculates water down the articulated well bore 30, alternative embodiments of the present invention may reverse the pumping direction and pump at least a portion of the water up the articulated and recirculate the water down the first well bore.

Figure 3:
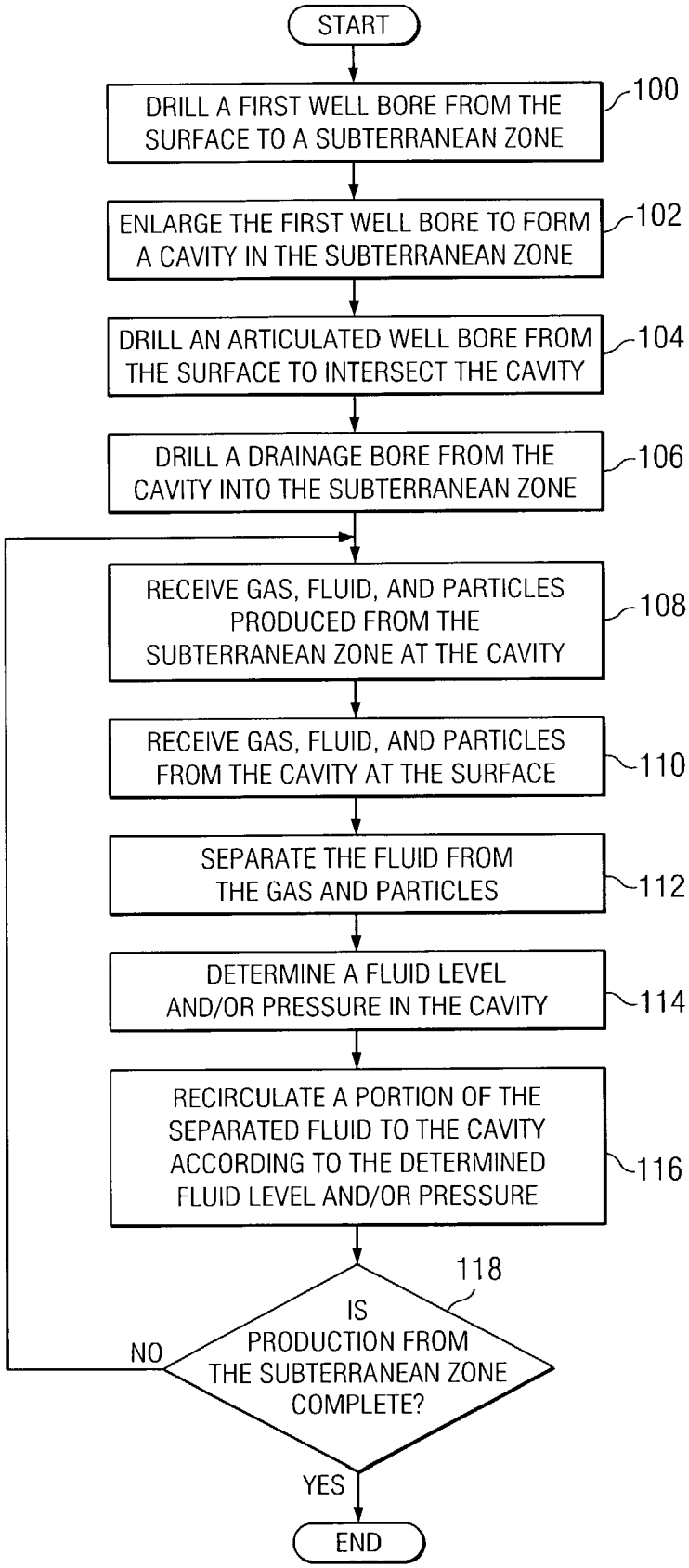
FIG. 3 illustrates an example method of recirculating water in a multi-well system.

FIG. 3 illustrates an example method of recirculating water in a multi-well system. The method begins at step 100 where a first well bore 12 is drilled from a surface 14 to a subterranean zone. In particular embodiments, the subterranean zone may comprise a coal seam 15. At step 102, an enlarged cavity 20 is formed from the first well bore 12 in or proximate to the subterranean zone. As described above, some embodiments may omit this cavity 20, and thus this step would not be performed in such embodiments. At step 104 an articulated well bore 30 is drilled from the surface 14 to the subterranean zone. The articulated well bore 30 is horizontally offset from the first well bore 12 at the surface 14 and intersects the first well bore 12 or the cavity 20 formed from the first well bore 12 at a junction proximate the subterranean zone. At step 106, a drainage bore 40 is drilled from the junction into the subterranean zone. This step may also include drilling a drainage pattern from the drainage bore 40.

At step 108, gas, water (and/or other liquid), and particles that are produced from the subterranean zone are received at the cavity 20 (or junction) via the drainage bore 40. As described above, in certain embodiments, the subterranean zone is a coal seam 15 which produces methane gas, water, and coal fines or other particles. At step 110, the gas, water, and particles are received at the surface from the cavity (or junction). As described above, the gas, water, and particles may be produced up the first well bore 12 using gas-lifting (either using formation pressure or artificial gas-lifting), pumping, or any other suitable technique. Furthermore, the gas and water may be lifted together and/or separately. In other embodiments, the gas and/or water may be lifted to the surface via the articulated well bore 30.

At step 112, the water, the gas, and the particles are separated from one another using a separator 62 or any other appropriate device(s). Although a single separator 62 is described above, multiple separators may be used. For example, a first separator may be used to separate the gas from the water and the particles, and a second separator may be used to separate the particles from the water. At step 114, a sensor or other suitable technique is used to determine the water level and/or the pressure in the cavity 20 (or other suitable location). As described above, this water level and/or pressure affects the rate at which water is extracted from the subterranean zone, controls gas surges from the subterranean zone, and assists in removing the particles from the cavity 20 to the surface 14.

At step 116, a portion of the separated water is recirculated into the cavity 20 (or junction) according to the determined water level and/or pressure. For example, based on a desired hydrostatic head, a certain water level may be maintained in the cavity 20 by recirculating water produced from the subterranean zone. The rate of the pump 72 may be varied to vary the amount of water being recirculated at any given instant, so that the water level may be maintained in the cavity 20 even though variable amounts of water may be produced into the cavity 20 from the subterranean zone. Alternatively, the bottom hole pressure in the cavity 20 or other suitable location may be measured, and the rate at which the water is recirculated may be varied to maintain this bottom hole pressure substantially constant. As described above, the water may be recirculated down the articulated well bore 30 or down the first well bore 12.

At decisional step 118, if production from the subterranean zone is complete, the method ends. If production is not complete, the method returns to step 108, where additional gas, water, and particles are received from the subterranean zone. Although steps 108 through 116 are described sequentially, it should be understood that these steps also occur simultaneously since gas, water, and particles are typically continuously received from the subterranean zone. Furthermore, although particular steps have been described in associated with the example method, other embodiments may include less or fewer steps, and the steps described above may be modified or performed in a different order.

Figure 4:
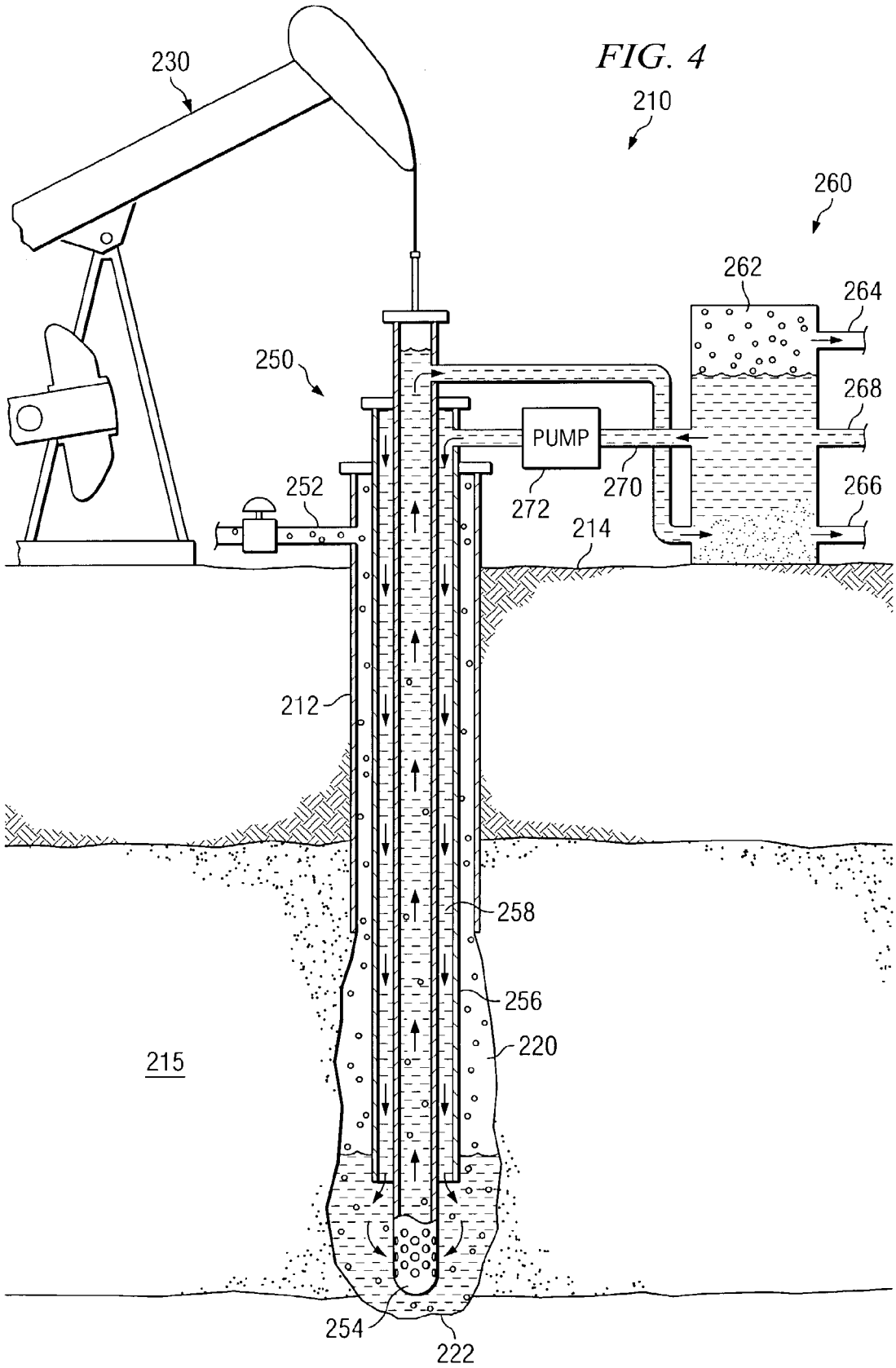
FIG. 4 illustrates an example single-well system using recirculation of produced fluid in accordance with an embodiment of the present invention.

FIG. 4 illustrates an example single well system 210 for production of fluids from a subterranean, or subsurface, zone in accordance with another embodiment of the present invention. In this embodiment, the subterranean zone is a coal seam, from which coal bed methane (CBM) gas, entrained water and other fluids are produced to the surface. However, system 210 may be used to produce fluids from any other suitable subterranean zones, such as other formations or zones including hydrocarbons.

System 210 includes a well bore 212 extending from the surface 214 to a target coal seam 215. The well bore 212 intersects the coal seam 215 and may continue below the coal seam 215. The well bore 212 may be lined with a suitable well casing that terminates at or above the level of the coal seam 215. The well bore 212 may be vertical, substantially vertical, straight, slanted and/or otherwise appropriately formed to allow fluids to be pumped or otherwise lifted up the well bore 212 to the surface 214. Thus, well bore 212 may include suitable angles to accommodate surface 214 characteristics, geometric characteristics of the coal seam 215, characteristics of intermediate formations and/or may be slanted at a suitable angle or angles along its length or parts of its length.

A cavity 220 is disposed in the well bore 212 proximate to the coal seam 215. The cavity 220 may be wholly or partially within, above or below the coal seam 215 or otherwise in the vicinity of the coal seam 215. A portion of the first well bore 212 may continue below the enlarged cavity 220 to form a sump 222 for the cavity 220. The cavity 220 provides a collection point for fluids drained from the coal seam 215 during production operations and may additionally function as a surge chamber, an expansion chamber and the like.

The cavity 220 is illustrated in FIG. 4 as having an irregular shape, unlike the cavities 20 described above. The cavity 220 may be an enlarged portion of well bore 212 that is formed using explosives or other similar techniques and thus have such an irregular shape. Alternatively, the cavity 220 may be formed using suitable underreaming techniques, as described with reference to the cavities 20 described above. Cavities 20 may alternatively be formed having an irregular shape, as illustrated by cavity 220. Furthermore, in certain embodiments, the cavity 220 may be omitted.

After well bore 212 has been drilled, the well bore 212 is capped. Due to pressure in the coal seam 215, water, gas and other fluids may flow from the coal seam 215 into cavity 220 and well bore 212. Production of the water, gas and/or other fluids from the coal seam 215 may then occur, in the illustrated embodiment, through the well bore 212.

As is illustrated in FIG. 4, a pump 230 may be installed to pump the produced water from cavity 220. The pump 230 may be a sucker rod pump, a Moineau pump, a progressive pump, or other suitable pump operable to lift fluids up the well bore 212. The pump 230 may be operated continuously or as needed to remove water drained from the coal seam 215 into the cavity 220.

As gas and water flows from the coal seam 215 to the well bore 212, coal fines generated during drilling of the well bore 212 and formation of the cavity 220, coal particles from the coal seam 215, and/or other particles are deposited in the cavity 220. Some of these particles may be pumped up the well 212 to the surface 214. However, some of the particles settle in the cavity 220 and in the sump 222 and build-up over time. Furthermore, a decrease in the amount of water flowing from the coal seam causes an increase in this build-up since there is less water to suspend the particles in cavity 220 and carry them to the surface 214. This build-up of particles is detrimental to the production of gas from the coal seam 215 since this build-up hinders the flow of gas to the surface and reduces the portion of the cavity 220 which may be used as a sump to collect water produced from the coal seam 215. To address this build-up issue, the well system 210 may include a water separation/recirculation system 260, as described above with reference to multi-well systems 10 and 110.

Some or all of the gas produced from the coal seam 215 may be separated in the cavity 220 from any produced water. This separated gas flows to the surface 214 via the well 212 and is removed via a piping 252 attached to a wellhead apparatus 250. Some gas produced from the coal seam 215 may remain entrained in the water that is produced from the coal seam 215. In the illustrated embodiment, this water and any entrained gas (along with particles) are pumped up a tubing 254 that extends from the cavity 220 up the well and through the wellhead apparatus 250 to the separation/recirculation system 260.

The water, gas, and particles produced up tubing 254 are communicated to a gas/liquid/solid separator 262 that is included in the separation/recirculation system 260. This separator 262 separates the gas, the water, and the particles and lets them be dealt with separately. Although the term "separation" is used, it should be understood that complete separation may not occur. For example, "separated" water may still include a small amount of particles. Once separated, any gas produced up tubing 254 may be removed via outlet 264 for further treatment (if appropriate), the particles may be removed for disposal via outlet 266, and the water may be removed via outlet 268 and/or outlet 270. As described above, although a single separator 262 is shown, any gas may be separated from the water in one apparatus and the particles may be separated from the water in another apparatus. Furthermore, although a separation tank is shown, one skilled in the art will appreciate numerous different separation devices may be used and are encompassed within the scope of the present invention.

As mentioned above, the separated water may be removed from the separator 262 via outlets 268 and/or 270. Water removed via outlet 268 is removed from well system 210 and is piped to a appropriate location for disposal, storage, or other suitable uses. Water removed via outlet 270 is piped to a pump 272 that directs the water, at a desired rate, back into well 212. As described above, this recirculation of water may be used to address the particle build-up and surging issues, as described above. It will be understood that although two water outlets 268 and 270 are described, water may be removed from the separator 262 via a single outlet and then piped as necessary for disposal or recirculation.

Well system 210 also includes a second tubing 256 in which tubing 254 is disposed. Because tubing 254 has a smaller diameter that tubing 256, an annulus 258 is formed between tubing 254 and tubing 256. In the illustrated system 210, the recirculated water produced from the coal seam 215 is pumped from the separator 262 using the pump 272 and flows down the well bore 212 and into cavity 220 via the annulus 258. This recirculation of water may be used to add water to the cavity 220 to keep or place particles in the cavity 220 in suspension so that they may be carried to the surface 214 via tubing 254. The recirculated water flowing down the annulus 258 may also create turbulence in the cavity 220 to help stir up particles that have built-up in the cavity 220, so that they become suspended in the water. The pump 272 may be used to control the amount of water recirculated such that a near constant amount of water may flow up the well bore 212 regardless of the amount of water produced from the coal seam 215 at a particular instant. In other words, the recirculated water may be used to make up for a lack of or a decrease in the amount of water coming from the coal seam 215, so that enough water is present in cavity 220 to remove a sufficient amount of particles to the surface 214.

The rate at which the pump 230 removes water from cavity 220 up tubing 254 and the rate at which the pump 272 of the separation/recirculation system 60 recirculates water down the annulus 258 may be adjusted in a complementary manner as is appropriate to provide a sufficient amount of water in the cavity 220 to suspend the produced particles, while also providing a flow of water from the cavity 220 to remove a sufficient amount of the particles from the cavity 220.

The pump 272 may have an associated controller that determines how much water to recirculate based on readings from a water level or pressure sensor and that controls the rate of the pump 272 accordingly. Alternatively, the rate of water recirculation may be based on a measurement of the amount of solids in the produced water that is removed from the well 212. Moreover, although a pump is described, the water may be recirculated down the articulated well using compressed air or any other suitable techniques.

Although the present invention has been described with several embodiments, numerous changes, substitutions, variations, alterations, and modifications may be suggested to one skilled in the art, and it is intended that the invention encompass all such changes, substitutions, variations, alterations, and modifications as fall within the spirit and scope of the appended claims.

What is claimed is:

1. A method for recirculating fluid in a well system, comprising drilling a first well bore from a surface to a subterranean zone;

drilling an articulated well bore from the surface to the subterranean zone, the articulated well bore intersecting the first well bore at a junction proximate the subterranean zone;

drilling a drainage bore from the junction into the subterranean zone;

receiving gas, water, and particles produced from the subterranean zone at the junction via the drainage bore;

receiving gas, water, and particles from the junction at the surface;

separating the water received at the surface from the gas and the particles received at the surface;

determining a bottom hole pressure;

determining an amount of separated water to recirculate based at least in part on the bottom hole pressure; and recirculating a portion of the separated water into the junction from the surface according to the determination.

2. The method of claim 1, wherein determining an amount of separated water to recirculate comprises determining a water level at the junction.

3. The method of claim 1, further comprising enlarging the first well bore to form a cavity in the subterranean zone, wherein the cavity comprises the junction at which the articulated well bore intersects the first well bore.

4. The method of claim 1, further comprising drilling a drainage pattern in the subterranean zone from the drainage bore.

5. The method of claim 1, wherein the water is gas-lifted from the junction to the surface.

6. The method of claim 1, wherein the water is pumped from the junction to the surface.

7. The method of claim 1, wherein the water is recirculated to the junction from the surface via the articulated well bore.

8. The method of claim 1, wherein the water is recirculated to the junction from the surface via the first well bore.

9. The method of claim 1, wherein the subterranean zone comprises a coal seam.

10. The method of claim 1, further comprising positioning a tubing in the first well bore that extends from the surface to the junction, the tubing operable to communicate at least water from the junction to the surface.

11. The method of claim 10, wherein:

the tubing further comprises stirring arms coupled to a first end of the tubing that is positioned in the junction; and the method further comprises rotating the tubing to cause the stirring arms to rotate in the junction.

12. A multi-well system, comprising:

a first well bore extending from a surface to a subterranean zone;

an articulated well bore extending from the surface to the subterranean zone, the articulated well bore intersecting the first well bore at a junction proximate the subterranean zone;

a drainage bore extending from the junction into the subterranean zone; and a separation/recirculation system operable to:

receive, at the surface, gas, water, and particles produced from the subterranean zone via the drainage bore;

separate the water from the gas and the particles;

determine an amount of the separated water to recirculate based at least in part on a bottom hole pressure; and recirculate a portion of the separated water into the junction from the surface according to the determination.

13. The system of claim 12, wherein the separation/recirculation system is operable to determine an amount of separated water to recirculate based on a water level at the junction.

14. The system of claim 12, further comprising a cavity formed in the subterranean zone from the first well bore, wherein the cavity comprises the junction at which the articulated well bore intersects the first well bore.

15. The system of claim 12, further comprising a drainage pattern extending from the drainage bore in the subterranean zone.

16. The system of claim 12, wherein a pressure in the subterranean zone is operable to lift water that is received at the junction from the drainage bore to the surface.

17. The system of claim 12, further comprising a pump operable to lift water that is received at the junction from the drainage bore to the surface.

18. The system of claim 12, wherein the separation/recirculation system is operable to recirculate the water to the junction from the surface via the articulated well bore.

19. The system of claim 12, wherein the separation/recirculation system is operable to recirculate the water to the junction from the surface via the first well bore.

20. The system of claim 12, wherein the subterranean zone comprises a coal seam.

21. The system of claim 12, further comprising a tubing positioned in the first well bore and extending from the surface to the junction, the tubing operable to communicate at least water from the junction to the surface.

22. The system of claim 21, wherein:

the tubing further comprises stirring arms coupled to a first end of the tubing that is positioned in the junction; and a motor operable to rotate the tubing to cause the stirring arms to rotate in the junction.

23. A method for recirculating fluid in a well system, comprising:

drilling a well bore from a surface to a subterranean zone;

receiving gas, water, and particles produced from the subterranean zone in the well bore;

receiving gas, water, and particles from the well bore at the surface;

separating the water received at the surface from the gas and the particles received at the surface;

determining a bottom hole pressure in the well bore;

determining an amount of separated water to recirculate based at least in part on the desired bottom hole pressure; and recirculating a portion of the separated water into the well bore from the surface according to the determination.

24. The method of claim 23, wherein determining an amount of separated water to recirculate comprises determining a water level in the well bore.

25. The method of claim 23, further comprising enlarging the well bore to form a cavity in the subterranean zone.

26. The method of claim 25, further comprising positioning a tubing in the well bore that extends from the surface to the cavity, the tubing operable to communicate at least water from the cavity to the surface.

27. The method of claim 23, wherein the subterranean zone comprises a coal seam.

28. A well system, comprising:

a well bore extending from a surface to a subterranean zone; and a separation/recirculation system operable to:

receive, at the surface, gas, water, and particles produced from the subterranean zone via the well bore;

separate the water from the gas and the particles;

determine an amount of the separated water to recirculate based at least in part on a bottom hole pressure and; and recirculate a portion of the separated water into the well bore from the surface according to the determination.

29. The system of claim 28, wherein the separation/recirculation system is operable to determine an amount of separated water to recirculate based on a water level in the well bore.

30. The system of claim 28, further comprising a cavity formed in the subterranean zone from the well bore.

31. The system of claim 30, further comprising a tubing positioned in the well bore and extending from the surface to the cavity, the tubing operable to communicate at least water from the cavity to the surface.

32. The system of claim 28, further comprising a pump operable to lift water that is received in the well bore from the subterranean zone to the surface.

33. The system of claim 28, wherein the subterranean zone comprises a coal seam.

34. A method for recirculating fluid in a well system, comprising:

drilling a well bore from a surface to a subterranean zone;

receiving gas, water, and particles produced from the subterranean zone at the surface;

receiving gas, water, and particles from the junction at the surface;

separating the water received at the surface from the gas and the particles received at the surface;

determining an amount of separated water to recirculate based at least in part on an amount of particles received at the surface; and recirculating a portion of the separated water into the well bore from the surface according to the determination.

35. The method of claim 34 further comprising:

drilling an articulated well bore from the surface to the subterranean zone, the articulated well bore intersecting the well bore at a junction proximate the subterranean zone; and drilling a drainage bore from the junction into the subterranean zone; and wherein recirculating a portion of the separated water comprises recirculating a portion of the separated water into the junction from the surface according to the determination.

36. A well system, comprising:

a well bore extending from a surface to a subterranean zone; and a separation/recirculation system operable to:

receive, at the surface, gas, water, and particles produced from the subterranean zone;

separate the water from the gas and the particles;

determine an amount of the separated water to recirculate based at least in part on an amount of particles received at the surface; and recirculate a portion of the separated water into the well bore from the surface according to the determination.

37. The well system of claim 36 further comprising:

an articulated well bore extending from the surface to the subterranean zone, the articulated well bore intersecting the well bore at a junction proximate the subterranean zone; and a drainage well bore extending from the junction into the subterranean zone; and wherein the separation/recirculation system is operable to recirculate a portion of the separated water into the junction from the surface according to the determination.

* * * * *